US012330749B2

(12) United States Patent
Parker, III et al.

(10) Patent No.: US 12,330,749 B2
(45) Date of Patent: Jun. 17, 2025

(54) METHODS, SYSTEMS, AND APPARATUSES TO FACILITATE PROVIDING AND SUSTAINING A LAMINAR FLOW OF A FLUID ACROSS A VESSEL

(71) Applicant: Parker Maritime Technologies, LLC, Rhinecliff, NY (US)

(72) Inventors: William J. Parker, III, Rhinecliff, NY (US); Harold Thomas Workman, Lorton, VA (US); Katherine Howell Brinson, Tuscaloosa, AL (US)

(73) Assignee: Parker Maritime Technologies, LLC, Saratoga, CA (US)

( * ) Notice: Subject to any disclaimer, the term of this patent is extended or adjusted under 35 U.S.C. 154(b) by 576 days.

(21) Appl. No.: 17/572,415

(22) Filed: Jan. 10, 2022

(65) Prior Publication Data

US 2022/0219787 A1 Jul. 14, 2022

Related U.S. Application Data

(60) Provisional application No. 63/136,147, filed on Jan. 11, 2021.

(51) Int. Cl.
*B63B 1/38* (2006.01)

(52) U.S. Cl.
CPC ..... *B63B 1/38* (2013.01); *B63B 2001/387* (2013.01)

(58) Field of Classification Search
CPC ..... B63B 1/38; B63B 2001/387
See application file for complete search history.

(56) References Cited

U.S. PATENT DOCUMENTS 1,894,256 A 1/1933 De Ganahl et al.
3,016,865 A 1/1962 Eichenberger
(Continued)

FOREIGN PATENT DOCUMENTS

GB 2382801 A 6/2003
WO 2009/122100 A1 10/2009
(Continued)

OTHER PUBLICATIONS

International Search Report and Written Opinion mailed Oct. 13, 2022, directed to International Application No. PCT/US2022/073942; 8 pages.
(Continued)

*Primary Examiner* — Anthony D Wiest
(74) *Attorney, Agent, or Firm* — Morrison & Foerster LLP

(57) ABSTRACT

The present disclosure relates generally to the field of facilitating a laminar flow and sound mitigation between a wetted hull of a vessel and surrounding fluid. More specifically, the present disclosure includes methods, systems, and apparatuses to facilitate providing and sustaining a laminar flow of a fluid across a vessel. A system for sustaining laminar flow of a fluid across a vessel comprising a main control unit. The main control unit comprises one or more air compressor units configured to generate air. An integrated longitudinal air distribution assembly is secured to a wetted hull of the vessel. The distribution assembly comprises a series of air dispersal modules configured to distribute the generated air across the wetted hull of the vessel to create at least one air layer between the wetted hull of the vessel and the fluid to sustain the laminar flow of the fluid across the vessel.

21 Claims, 19 Drawing Sheets

(56) References Cited

U.S. PATENT DOCUMENTS

| | | | | |
|---|---|---|---|---|
| 3,455,266 | A | 7/1969 | Giles | |
| 4,922,844 | A | 5/1990 | Solia | |
| 5,149,043 | A | 9/1992 | Grundmann | |
| 5,524,568 | A * | 6/1996 | Bobst | B63B 1/38 114/67 A |
| 5,967,071 | A | 10/1999 | Wipper | |
| 6,356,816 | B1 | 3/2002 | Katz | |
| 6,883,450 | B2 | 4/2005 | Kingsbury | |
| D576,721 | S | 9/2008 | Nishio et al. | |
| D576,722 | S | 9/2008 | Nishio et al. | |
| D586,454 | S | 2/2009 | Nishio et al. | |
| 7,997,221 | B2 | 8/2011 | Costas | |
| 8,196,536 | B1 | 6/2012 | Harbin | |
| 8,931,752 | B2 | 1/2015 | Roberts | |
| D767,111 | S | 9/2016 | Glick, Jr. | |
| D770,028 | S | 10/2016 | Glick, Jr. | |
| 10,029,770 | B2 * | 7/2018 | Johannesson | B63B 1/38 |
| 10,730,588 | B2 | 8/2020 | Yousef | |
| 2008/0083361 | A1 | 4/2008 | Schoo | |
| 2009/0233502 | A1 | 9/2009 | Wellman | |
| 2009/0260561 | A1 | 10/2009 | Takahashi | |
| 2016/0075406 | A1 | 3/2016 | Johannesson | |
| 2016/0185423 | A1 | 6/2016 | Takano | |
| 2018/0229808 | A1 | 8/2018 | Wang | |
| 2023/0034377 | A1 | 2/2023 | Parker, III et al. | |
| 2023/0147120 | A1 * | 5/2023 | Kapteijn | B63B 1/38 114/67 A |

FOREIGN PATENT DOCUMENTS

| | | | |
|---|---|---|---|
| WO | 2010/064911 | A1 | 6/2010 |
| WO | 2011/119182 | A2 | 9/2011 |
| WO | 2011/161187 | A1 | 12/2011 |

OTHER PUBLICATIONS

Parker et al., U.S. Office Action dated Dec. 6, 2023, directed to U.S. Appl. No. 29/771,318; 10 pages.

Parker et al., U.S. Office Action dated Nov. 22, 2023, directed to U.S. Appl. No. 17/382,238; 7 pages.

International Search Report and Written Opinion mailed Mar. 25, 2022, directed to International Application No. PCT/US2022/70123; 8 pages.

* cited by examiner

Figure 1: Laminar vs Turbulent Flow

Figure 2: Main Control Unit (3D View)

Figure 3: Main Control Unit (Right-Side View)

Figure 4: Main Control Unit (Left-Side View)

Figure 7: Air Dispersal Module (Front View)

Figure 8: Air Dispersal Module (Bottom View)

Figure 9: Ball and Socket Joint (Bottom View)

Figure 11: Forward Securing Bridle (Front View)

Figure 13: Transverse Stability Band (Forward View)

Figure 15: Multi-Directional Securing Device (Bottom View)

Figure 16: Multi-Directional Securing Device (Side View)

Figure 17: Multi-Directional Securing Device (Componet View)

Figure 18: Main Control Unit Air Flow

METHODS, SYSTEMS, AND APPARATUSES TO FACILITATE PROVIDING AND SUSTAINING A LAMINAR FLOW OF A FLUID ACROSS A VESSEL

CROSS-REFERENCE TO RELATED APPLICATION

This application claims the benefit of U.S. Provisional Application No. 63/136,147, filed on Jan. 11, 2021, the entire contents of which are incorporated herein by reference for all purposes.

FIELD OF INVENTION

The embodiments of the present disclosure relates generally to the field of facilitating a laminar flow and sound mitigation between a wetted hull of a vessel and surrounding fluid. More specifically, the present disclosure includes methods, systems, and apparatuses to facilitate providing and sustaining a laminar flow of a fluid across a vessel.

BACKGROUND

Existing techniques for facilitating providing and sustaining a laminar flow of a fluid across a vessel are deficient with regard to several aspects. For instance, current technologies do not reduce viscous resistance ($R_V$) across a greater surface area but focus solely upon the flat-bottom portion of the wetted hull. Furthermore, current technologies do not facilitate installation of a system in a displacement vessel during construction, retrofitting, while underway and/or in-port but employ multiple hull access cuts to create air distribution cavities, and require dry-docking to support the installation. Moreover, current technologies do not facilitate operational and environmental enhancements resultant from employing the system on the displacement vessel.

Therefore, there is a need for improved methods, systems, and apparatuses to facilitate providing and sustaining a laminar flow of a fluid across a vessel that may overcome one or more of the above-mentioned problems and/or limitations.

BRIEF SUMMARY

This summary is provided to introduce a selection of concepts in a simplified form that are further described below in the Detailed Description. This summary is not intended to identify key features or essential features of the claimed subject matter. Nor is this summary intended to be used to limit the claimed subject matter's scope.

According to some embodiments, a system to facilitate providing and sustaining of laminar flow of a fluid across a vessel, is disclosed. Further, the system may facilitate one or more of production, distribution, and sustainment of an airflow between wetted surface of the vessel and the fluid. Further, the airflow may be based on at least one air layer that may be established between a wetted hull of the vessel and surrounding fluid (such as water) corresponding to the wetted hull. Further, the system may be configured to reduce viscous resistance ($R_V$) across the wetted hull that may result from movement of the vessel through the surrounding fluid based on the at least one air layer. Further, the system may be configured to attenuate noise that may emanate from the vessel into the surrounding fluid based on the established at least one air layer. Further, the system may be configured to reduce rate of marine growth across the wetted hull based on the established at least one air layer. Further, the system may be configured to enhance fuel economy that may be based on an increased laminar flow and a decreased turbulent flow across the wetted hull at an instance of the vessel transiting through the surrounding fluid. Further, the system may facilitate leveraging inherent efficiency of the laminar flow based on extending of a network associated with the system across a surface area of the wetted hull of the vessel.

An exemplary system for sustaining laminar flow of a fluid across a vessel, comprising: a main control unit comprising one or more air compressor units, the one or more air compressor units configured to generate air; an integrated longitudinal air distribution assembly secured to a wetted hull of the vessel, the integrated longitudinal air distribution assembly comprising a series of air dispersal modules configured to distribute the generated air across the wetted hull of the vessel to create at least one air layer between the wetted hull of the vessel and the fluid to sustain the laminar flow of the fluid across the vessel.

In some embodiments, the main control unit further comprises an air manifold configured to discharge the air out of the main control unit.

In some embodiments, the system further comprises: one or more air hoses configured to transfer the air from the main control unit to the series of air dispersal modules.

In some embodiments, the integrated longitudinal air distribution assembly further comprises: one or more support cables extending longitudinally along the wetted hull, wherein a proximal end of the support cable is positioned at a bow of the vessel, and wherein a plurality of the air dispersal modules are attached to the support cable.

In some embodiments, the system further comprises: one or more anchoring points on the wetted hull, wherein the one or more anchoring points are configured to secure the one or more support cables to the wetted hull.

In some embodiments, the system further comprises: a bridle positioned at a bow of the vessel.

In some embodiments, the bridle comprises a bridle ring affixed to the bow of the vessel.

In some embodiments, the system further comprises: a transverse stability band, wherein the transverse stability band is configured to traverse from one side of the vessel to the bottom of the wetted hull to an opposite side of the vessel.

In some embodiments, the system further comprises: a multi-directional securing device, the multi-directional securing device comprising one or more longitudinal pipe shields and one or more transverse pipe shields, wherein the one or more longitudinal pipe shields and the one more or transverse pipe shields are oriented in a perpendicular configuration.

In some embodiments, the system is further configured to be installed while the vessel remains in the fluid.

In some embodiments, the at least one air dispersal module is further configured to generate the at least one air layer by producing a plurality of bubbles.

In some embodiments, the system is further configured to be installed by connecting the main control unit to the series of air dispersal modules along an exterior of the vessel.

In some embodiments, the at least one main control unit further comprises sound-dampening material.

In some embodiments, the system further comprises an operating panel for controlling the one or more air compressor units, the operating panel configured to support a first mode for operating at sea, a second mode for operating in port, a third mode for ceasing operation, or any combination thereof.

In some embodiments, the one or more air compressor units in the first mode is configured to provide low-pressure air ranging from 30-120 pound-force per square inch.

In some embodiments, the one or more air compressor units in the second mode is configured to provide a minimal air supply pressure ranging from 5-55 pound-force per square inch.

In some embodiments, the one or more air compressor units in the third mode is configured to eliminate all air supply.

In some embodiments, the at least one air compressor unit is further configured to be operable with water.

In some embodiments, each of the series of air dispersal modules is further configured to have a trident-shaped body.

In some embodiments, each of the series of air dispersal modules comprises a magnet configured to secure the air dispersal module to the wetted hull.

In some embodiments, each of the series of air dispersal modules further comprises a plurality of air discharge ports configured to discharge at least a portion of the air out of the air dispersal module.

In some embodiments, each of the series of air dispersal modules further comprises an air supply hose configured to transfer at least a portion of the air through the air dispersal module.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and sub-combinations described in the detailed description.

DESCRIPTION OF THE FIGURES

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAILED DESCRIPTION

Figure 1:
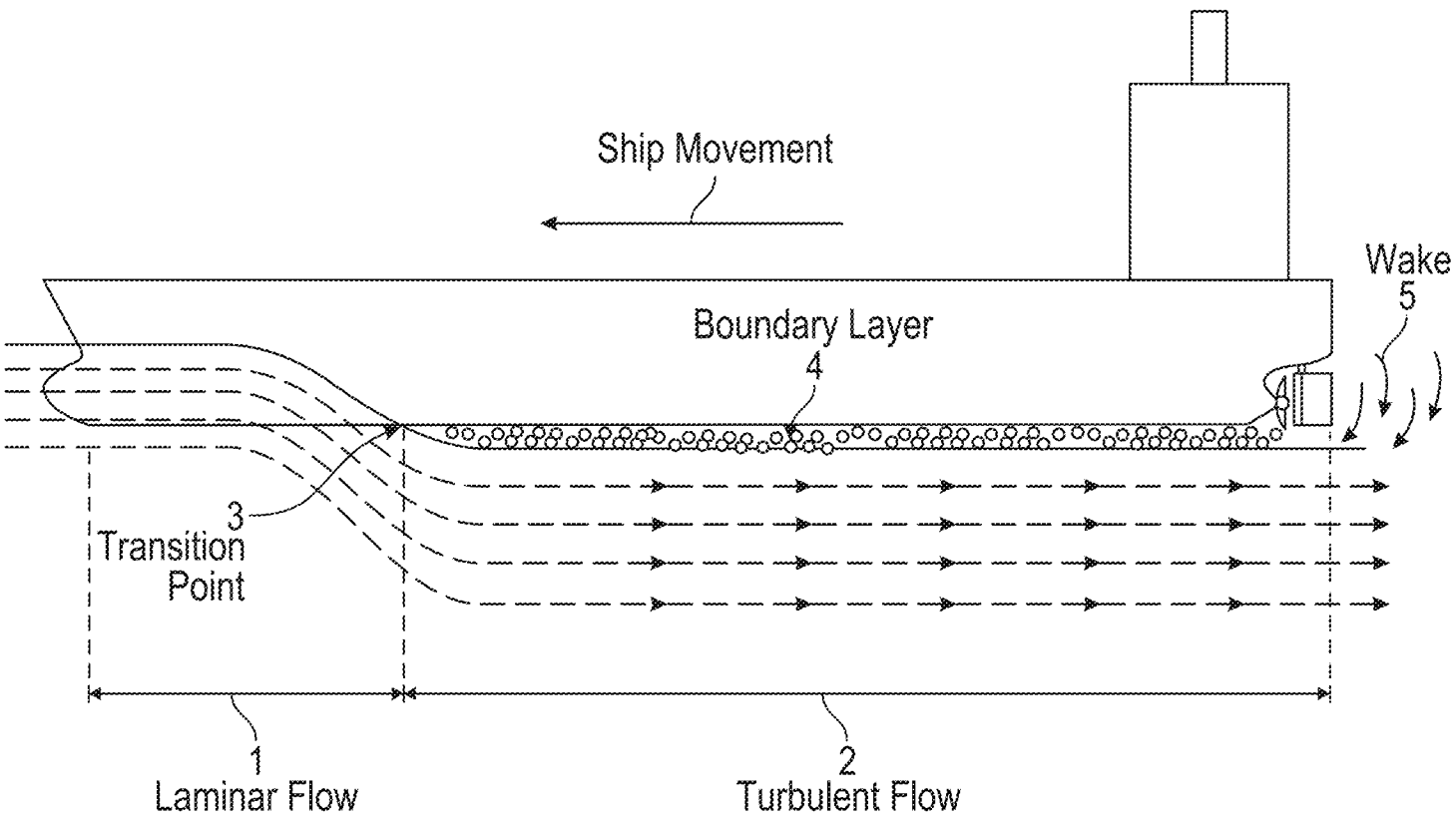
FIG. 1 is an illustration depicting laminar flow and turbulent flow of a fluid across a vessel, in accordance with some embodiments.

The following description is presented to enable a person of ordinary skill in the art to make and use the various embodiments. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the various embodiments. Thus, the various embodiments are not intended to be limited to the examples described herein and shown, but are to be accorded the scope consistent with the claims.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing from here, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of providing and sustaining a laminar flow of a fluid across a vessel, embodiments of the present disclosure are not limited to use only in this context.

Overview:

The present disclosure describes methods, systems, and apparatuses to facilitate providing and sustaining a laminar flow of a fluid across a vessel. Further, the disclosed methods, systems, and apparatuses aim to facilitate moving of the vessel through the fluid (e.g., water, etc.). Further, the disclosed apparatuses and system aim to keep the vessel afloat on the fluid at an instance of moving of the fluid. Further, in some embodiments, the disclosed methods, systems, and apparatuses may include externally mounted, longitudinally distributed, hydrodynamically shaped air dispersal modules to distribute and/or sustain at least one air layer between a wetted surface (e.g., hull) of the vessel and the fluid that may surround the vessel. Further, the at least one air layer may facilitate reducing viscous friction between the wetted surface and the fluid such that the at least one air layer may enhance sound insulation between the wetted surface and the fluid. Further, the reduction in the viscous friction may increase the laminar flow across the wetted surface of the vessel that may decrease, for instance, total resistance of the wetted surface and effective horsepower (EHP) (i.e., the horsepower required to move the hull of the vessel at a given speed in absence of propeller action), and may increase the fuel efficiency of the vessel. Further, the disclosed methods, systems, and apparatuses may facilitate reducing carbon emissions based on the increased fuel efficiency that may reduce operating costs of the vessel. Further, the reduction in the carbon emission, the EHP, consumption of fossil fuel, and/or noise levels may improve the quality of the environment in the long run and support the protection of marine mammals. Further, the system installation is configured to be completed in less than one week.

Further, the disclosed methods, systems, and apparatuses may include self-contained and redundant air compressors that may facilitate producing and sustaining a sufficient air quantity and/or air pressure. Further, the sufficient air quantity and/or the air pressure may create and/or maintain the at least one air layer that may facilitate the providing and the sustaining of the laminar flow of the fluid across the vessel. Further, in some embodiments, air dispersal based on the sufficient air quantity and/or the air pressure across the wetted surface may be achieved using a series of hydrodynamically configured, interlocking sections of malleable, recycled, composite material surrounding a central reinforced air supply. Further, in some embodiments, the sections may be arranged in a series of longitudinal assemblies anchored at and/or near the bow area of the vessel (e.g., a boat, etc.) and extending toward the stern in lengths and/or diameters that may be necessary to maximize coverage of the disclosed methods, systems, and apparatuses on the wetted surface. Further, in some embodiments, the assemblies mentioned thereof may be secured using a series of magnets and/or cables that may be included within the composite material, and strategically placed transverse cables that may be equipped with connective unions. Further, in some embodiments, strategically placed air discharge ports may penetrate interior air supply line and surrounding, hydrodynamically shaped, protective shroud, thus facilitating distribution and sustainment of a thin at least one air layer across the wetted surface.

Further, the disclosed methods may facilitate equipping the disclosed apparatuses and systems to a displacement vessel at an instance of construction and/or retrofitting. Further, the disclosed methods may facilitate operating the disclosed apparatuses and systems in the displacement vessel in an instance of the displacement vessel being underway and/or in-port.

Further, the disclosed methods, systems, and apparatuses may facilitate reducing the viscous resistance resulting from friction incurred by the wetted surface of the hull of the vessel at an instance of the vessel moving through the fluid (e.g., seawater and/or freshwater). Further, the reduction in the viscous resistance may reduce total hull resistance ($R_T$), thus reducing the effective horsepower (EHP) that may be needed to propel the vessel through the surrounding fluid. Further, the reduction in the EHP needed to propel the vessel across an operational speed range may reduce both the fuel consumption and discharge of environmental emissions associated with power generation. Further, the noise pollution propagating beneath a surface of the fluid (e.g., surface of the water) that may be created by sound emanating from the hull of the vessel and propeller cavitation may be mitigated. Further, rate of marine growth (such as, sea worms, mollusks, barnacles, algae, hard shells like acorn barnacle, etc. that may stick to the wetted surface of the hull and flourish) may be reduced. Further, the disclosed methods, systems, and apparatuses may facilitate supporting waterborne installation (i.e., no requirement to drydock the vessel for installation process associated with different components of the vessel.)

Further, the disclosed methods, systems, and apparatuses aim to achieve one or more objectives. Further, the one or more objectives may include:

- To provide an improved system for producing, distributing, and sustaining air between the wetted surface of the hull of the vessel and the surrounding fluid as the vessel transits.
- To provide a system for integrating the production, distribution, and sustainment of the at least one air layer between the wetted surface and the surrounding water as the vessel transits for combined purposes, such as, for example, reducing viscous resistance ($R_V$), providing sound insulation, etc.
- To extend the $R_V$ reduction and the sound insulation to a level at and/or near entirety of the wetted surface that may extend the laminar flow beyond the bottom of the hull, and may concurrently enhance attributes of the sound insulation.
- To provide a method of operating such a system in the displacement vessel.
- To provide a method for incorporating such a system into the construction and/or the retrofitting of maritime displacement vessels of varying sizes and hull forms without, for instance, a dry-docking requirement, weakening of the hull, and/or interference to any other shipboard equipment, systems, or discharges.
- To provide a method for installing and/or the retrofitting such a system aboard the vessel without interference to cargo space of the vessel, cargo-carrying capacity, and/or cargo handling.
- To provide a system for producing, distributing, and sustaining the at least one air layer between the wetted surface and the surrounding fluid that may facilitate operation in an efficient and stable manner as the vessel transits in wave conditions.

Further, the disclosed methods, systems, and apparatuses may provide a system that may produce, distribute, and/or sustain the at least one air layer between the wetted surface of the hull of the vessel and the surrounding fluid as the vessel transits. Additionally, and/or alternatively, the at least one air layer may satisfy the one or more objectives mentioned thereof. Further, the disclosed methods, systems, and apparatuses may facilitate leveraging principles of one or more of fluid mechanics, hydrodynamics, aerodynamics, sound propagation, laminar/turbulent fluid flow, etc. in order to meet the one or more objectives. Further, corresponding applicability associated with the principles of the one or more of fluid mechanics, hydrodynamics, aerodynamics, sound propagation, laminar/turbulent fluid flow may be as follows:

- Fluid Mechanics: The disclosed methods, systems, and apparatuses may facilitate discharging of the air below the hull of a waterborne vessel, wherein a combination of rising air and vessel movement may form the at least one air layer across the wetted surface of the hull.
- Hydrodynamics: The at least one air layer between wetted hull and the surrounding fluid may facilitate a reduction in the viscous resistance ($R_V$) between the wetted hull and the surrounding fluid, wherein motion of the fluid across a transiting vessel, and movement of the wetted hull through the surrounding fluid may be influenced by the viscous resistance ($R_V$) associated with physical contact (such as, friction) between the wetted hull and the surrounding fluid.
- Aerodynamics: The at least one air layer created between the wetted hull and the surrounding fluid may allow the wetted hull to transit through the fluid bearing less resistance than an exclusive fluid medium that may be because of fluid resistance (e.g., water resistance) exceeding air resistance, that may result in the reduction of the viscous resistance ($R_V$) between the wetted hull and the surrounding fluid.
- Sound Propagation (in air/in water): Air buffer corresponding to the at least one air layer between the wetted hull and the surrounding may facilitate the sound insulation by diminishing amplitude of sound waves emanating from the hull and propeller cavitation.
- Laminar Flow (1): Streamlined fluid flow across the wetted surface of the hull of the vessel may be enhanced based on the reduction in the viscous resistance ($R_V$) corresponding to the creation of the at least one air layer between the wetted hull of the waterborne vessel and the surrounding fluid, thus enhancing the laminar flow.
- Turbulent Flow (2): Stabilization of pressure and flow velocity, as well as a reduction in mixing across layers, may be achieved based on the reduction in the viscous resistance ($R_V$), thus reducing the turbulent flow.
- Transition Point (3): The specific point at which laminar flow transitions to turbulent flow.
- Boundary Layer (4): This is the layer of a fluid where the effects of viscosity are most significant.

Wake (5): This is the region of disturbed flow which is downstream, in the opposite direction of ship movement from a solid body as it moves through a fluid.

Further, the disclosed methods, systems, and apparatuses described herein may be easily installed in new construction vessels and/or retrofitted aboard in-service vessels. Further, the installation may involve no hull access cuts and may be completed waterborne, thus eliminating the time, cost, operational impact, and risk associated with dry-docking. Further, the disclosed methods, systems, and apparatuses may be scalable to the displacement vessels of all sizes, hull forms, missions, and types of propulsion, and adaptable to support any unique wetted hull fixtures or access requirements. Further, the disclosed methods, systems, and apparatuses may eliminate interference with existing cargo capacity/handling, and may not impede current hull cleaning practices, and may be removable (each component of the system or as a whole) as required.

For vessels of increased large dimensions (such as, length, beam, draft, etc.), the surface area of the wetted hull, and thereby contributing to the viscous resistance ($R_V$), may be vast.

$$R_V = C_V \tfrac{1}{2} \rho V^2 S,$$

where, $R_V$=Viscous Resistance, $C_V$=Co-efficient of Viscous Resistance=Skin Friction ($C_f$)+Pressure Drag ($K*C_F$)=($C_F$+$K*C_F$)

→$C_F$=Tangential Component of ($R_V$), $K*C_F$=Normal Component of ($R_V$)

ρ=Fresh/Salt Water Density (lb-s$^2$/ft$^4$) (as applicable),

V=Velocity (ft/sec),

S=Wetted Surface Area of Underwater Hull (ft$^2$)

For this reason, Viscous Resistance ($R_V$) (friction) may overshadow wave-making resistance ($R_W$) and air Resistance ($R_A$), within the composition of total hull resistance ($R_T$).

$$R_T = R_V R_W + R_A,$$

where, $R_T$=Total Hull Resistance, $R_V$ =Viscous (Friction) Resistance, $R_W$=Wave-making Resistance, $R_A$=Air Resistance (Ship moving in calm air)

By establishing the at least one air layer that may span the majority of the wetted hull, the disclosed methods, systems, and apparatuses may decrease water friction, thereby decreasing the viscous resistance ($R_V$) and ultimately, the total hull resistance ($R_T$), and hence increasing fuel efficiency by decreasing the effective horsepower (EHP) that may be needed to propel the vessel through saltwater/freshwater across the operational speed range.

$$EHP = \frac{R_T V_S}{550 \frac{\text{ft} - \text{lb}}{\text{sec} - HP}}$$

Further, increased fuel efficiency contributes to reduced fuel demand and the reduced carbon emissions (e.g., for ships powered by fossil fuels). Further, the increased fuel efficiency may lower operating costs for vessel owners/operators, and simultaneously, reduce negative environmental impacts. Concurrently, the air buffer corresponding to the at least one air layer may facilitate mitigating the noise pollution entering the water as created by the wetted hull and the propeller cavitation. Further, speed of sound in water is approximately four times faster than the speed of sound in air, thus the air buffer surrounding the wetted hull may decrease and/or attenuate amplitude of sound waves emanating from the hull as energy carried by the sound waves may be lost to friction and the relaxation processes in the air.

$$v = (K\rho)^{-\left(\frac{1}{2}\right)},$$

where, v=Speed of Sound (ft/sec),

K=Compressibility of the Medium,

ρ=Density of the Medium

By producing and sustaining the at least one air layer between the wetted hull and the surrounding fluid, and by employing both underway and in-port operating modes, the disclosed methods, systems, and apparatuses may facilitate reducing the rate of marine growth across the surface area of the wetted hull.

Further, the disclosed methods, systems, and apparatuses may include at least six integral elements, each bearing critical sub-components. Further, the at least six integral elements not only facilitate production, distribution, and sustainment, of the at least one air layer between the wetted hull of the vessel and the surrounding fluid, but may ensure structural integrity, durability, and non-interference of the system with vessel operations. Further, the at least six integral elements may include:

(1) Main Control Units, (2) Air Dispersal Modules, (3) Forward Securing Bridle, (4) Integrated Longitudinal Air Distribution Assemblies, (5) Transverse Stability Bands, and (6) Multi-Directional Securing Devices.

Referring now to figures, FIG. 1 is an illustration depicting laminar flow and turbulent flow of a fluid across a vessel, in accordance with some embodiments. Further, a system to facilitate providing and sustaining of the laminar flow of the fluid across the vessel may facilitate one or more of production, distribution, and sustainment of airflow between wetted surface of the vessel and the fluid. Further, the vessel may include one or more types of watercrafts such as, but not limited to, a cruise ship, a submarine, a schooner, a yacht, and so on. Further, the fluid may include one or more types of fluids such as, but not limited to, water. Further, the air flow may be based on at least one air layer that may be established between a wetted hull of the vessel and surrounding fluid (such as, water) corresponding to the wetted hull. The wetted hull may be the entire surface area of the hull of a vessel, to include appendages below the waterline. Further, the system may be configured to reduce viscous resistance ($R_V$) across the wetted hull that may result from movement of the vessel through the surrounding fluid based on the at least one air layer. Further, the system may be configured to attenuate noise that may emanate from the vessel into the surrounding fluid based on the established at least one air layer. Further, the system may be configured to reduce rate of marine growth across the wetted hull based on the established at least one air layer. Further, the system may be configured to enhance fuel economy that may be based on an increased laminar flow and a decreased turbulent flow across the wetted hull at an instance of the vessel transiting through the surrounding fluid. Further, the system may facilitate leveraging inherent efficiency of the laminar flow based on extending of a network associated with the system across a surface area of the wetted hull of the vessel.

Figure 2:
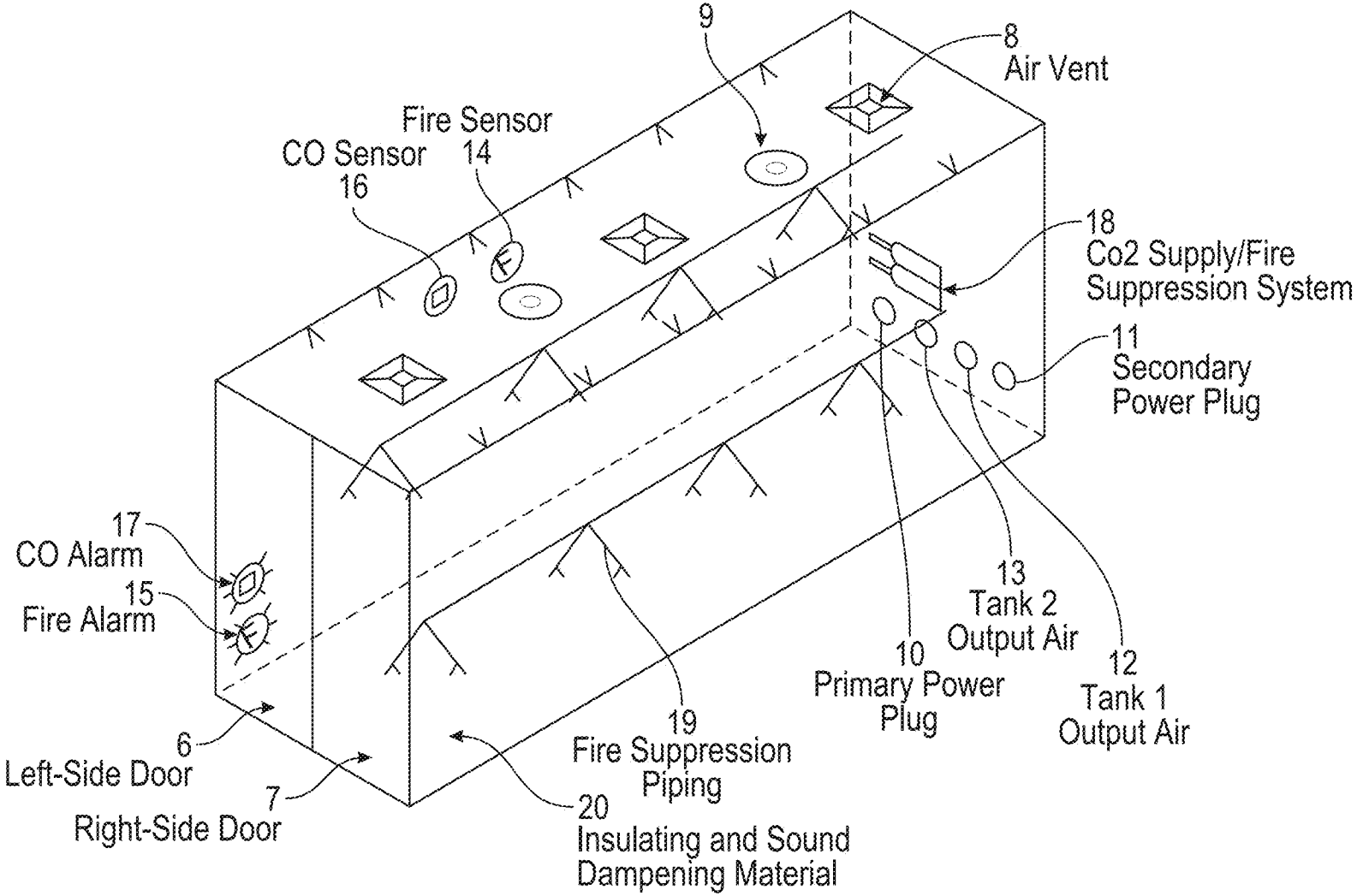
FIG. 2 is an exemplary representation of a top perspective view of a main control unit to facilitate providing and sustaining the laminar flow of the fluid across the vessel, in accordance with some embodiments.

FIG. 2 is an exemplary representation of a top perspective view of a main control unit to facilitate providing and sustaining the laminar flow of the fluid across the vessel, in accordance with some embodiments. Further, the system may include a plurality of main control units. Further, each main control unit of the plurality of main control units may include a series of self-contained, redundant, low-pressure one or more air compressor units. Further, the one or more air compressor units, in an instance, may be configured to generate the at least one air layer between the wetted hull and the surrounding fluid. Further, in some embodiments, a number of the main control units in the system may be based on a surface area of the wetted surface of the hull of the vessel that may correspond to size of the vessel. Further, in some embodiments, the each main control unit may include a boxed and/or containerized assembly that may include at least two air compressors and corresponding operating equipment such as, air storage tanks (24), intake and/or exhaust, ventilation, hazard alarms, fire-suppression, insulating, and sound dampening material. Further, in some embodiments, the at least two air compressors may be oil-free and low-pressurized for generating the at least one air layer. Such oil free compressors may use alternate materials to lubricate the compression chamber. Examples of oil free compressors include the use of Teflon coating or fresh water to assist the moving parts to operate smoothly. Further, the each main control unit may be mounted in an area inside the vessel that may result in little and/or no impact upon cargo carrying capacity or cargo handling operations of the vessel. Further, in some embodiments, the each main control unit may include at least one left-side door (6), at least one right-side door (7), one or more air vents (8), one or more air intakes (9), one or more primary (10) and/or secondary power plugs (11), one or more output air tank (12,13) to facilitate generating of the at least one air layer, one or more primary compressors (21) and/or alternate compressors or compressor (22) banks, one or more fire sensors (14) and alarms (15), one or more Carbon Monoxide (CO) sensors (16) and alarms (17), one or more carbon dioxide ($CO_2$) supplies (or, fire suppression systems) (18), at least one fire suppression piping (19), a base that may include insulating and/or sound dampening material (20) for preventing freezing and/or minimizing of noise emission, etc. Further, in some embodiments, the plurality of the main control units may draw 115V, 220V, and/or 440V based on requirements from respective parent vessel electrical distribution system. Further, in some embodiments, the each main control unit may include a start/stop mechanism and operating mode control mechanisms for the air compressors within the respective main control unit. Further, in some embodiments, the each main control unit may operate corresponding air compressors with at least half of total capacity at a particular instance, thereby ensuring full redundancy on a per-unit basis.

Figure 3:
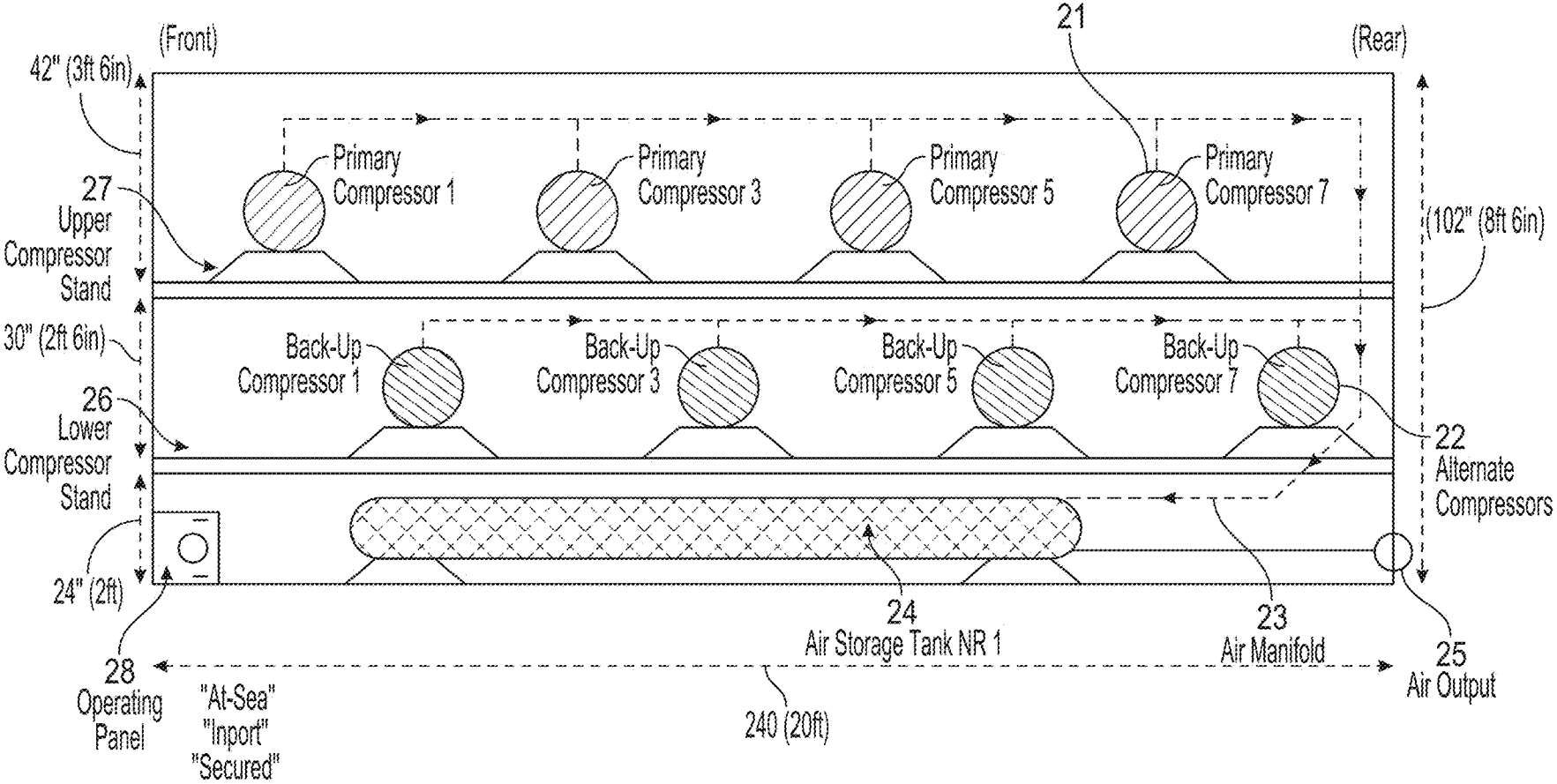
FIG. 3 is an exemplary representation of a right-side view of the main control unit, in accordance with some embodiments.

FIG. 3 is an exemplary representation of a right-side view of the main control unit to facilitate the providing and the sustaining of the laminar flow of the fluid across the vessel, in accordance with some embodiments. Further, the right-side view may depict configuration of the primary and/or alternate compressor banks. Additionally, and/or alternatively, the main control units may include operating panels (28) for the primary and/or the alternate compressors banks. Further, in some embodiments, the operation panels may be configured for transitioning between one or more modes of operation that may include, but not limited to, "at-sea," "in-port," and "secured." Further, the "at-sea" mode may provide a steady flow of low-pressure air, at an instance, ranging from 30-120 psi (or, pound-force per square inch). Further, in some embodiments, at least two primary and/or alternate compressors of the primary and/or alternate compressor banks in each main control unit may be arranged in lower and/or upper compressor stands (26, 27) that may facilitate maintaining air storage capacity of each of at least one air storage tank. Further, in some embodiments, the each main control unit may include at least two air storage tanks. Further, the at least two air storage tanks may facilitate an air supply, at an instance, ranging from 5-120 psi based on at least one air output (25) to a common air manifold (23). Further, the air manifold may facilitate discharging the air supply from the at least one air output to a strategically configured air distribution network that may be based upon dimensions (or, the size) of the corresponding vessel. Further, a normal "at-sea" mode operating pressure, in an instance, may range from 30-120 psi that may be measured at the air manifold. Further, the "in-port" mode, in an instance, may provide a minimal air supply pressure ranging from 5-55 psi throughout the system. Further, the minimal supply pressure, in an instance, may facilitate limiting marine growth on waterborne components of the system. Further, the minimal supply pressure may facilitate reducing the marine growth on the wetted hull of the corresponding vessel. Further, the "secured" mode may facilitate eliminating all of the air supply to the system. Further, in some embodiments, the "secured" mode may facilitate reserving of the air corresponding to instances such as, but not limited to, dry-docking, undergoing system maintenance, etc. of the corresponding vessel.

Figure 4:
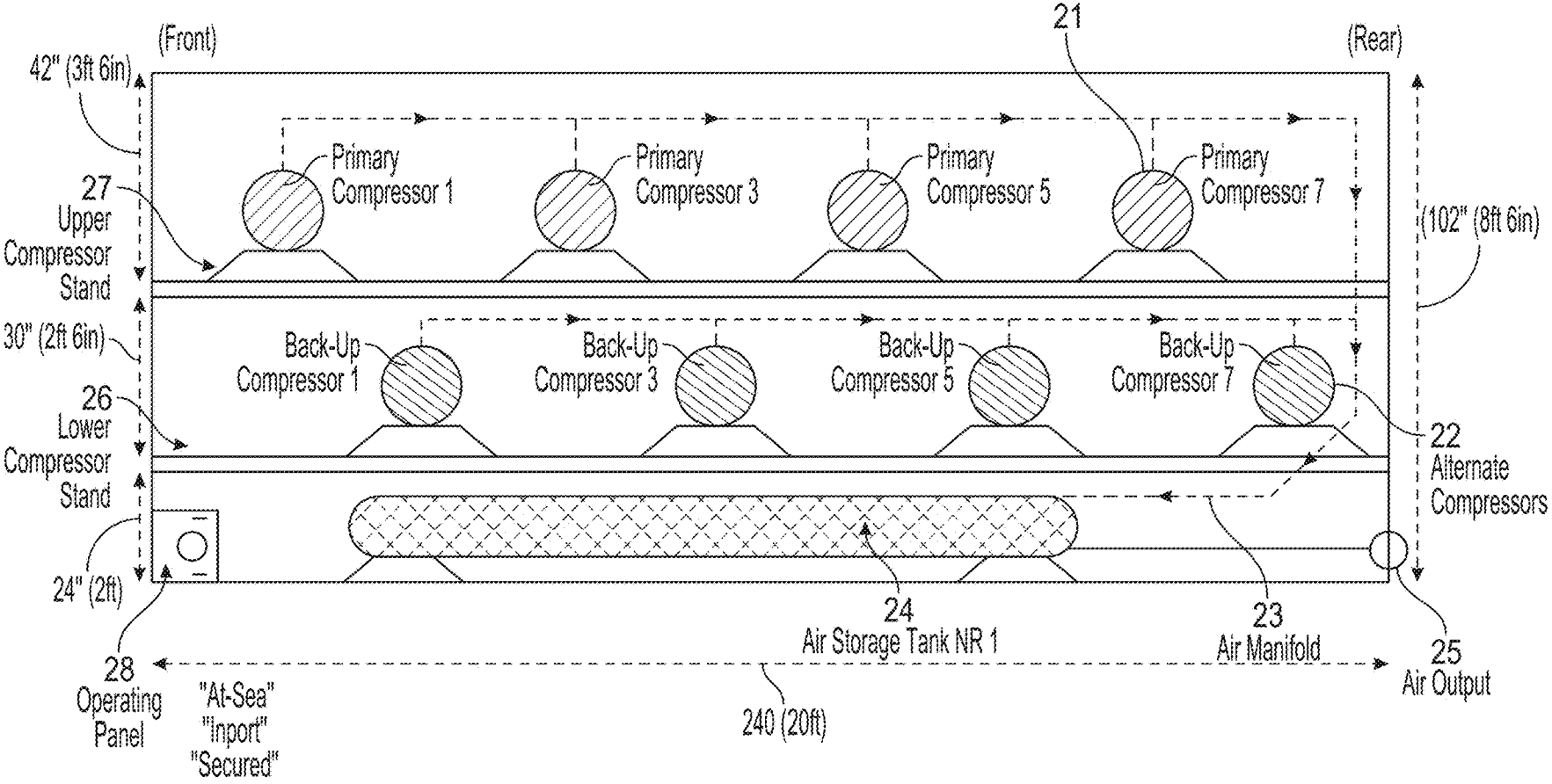
FIG. 4 is an exemplary representation of a left-side view of the main control unit, in accordance with some embodiments.

FIG. 4 is an exemplary representation of a left-side view of the main control unit to facilitate the providing and the sustaining of the laminar flow of the fluid across the vessel, in accordance with some embodiments.

Figure 5:
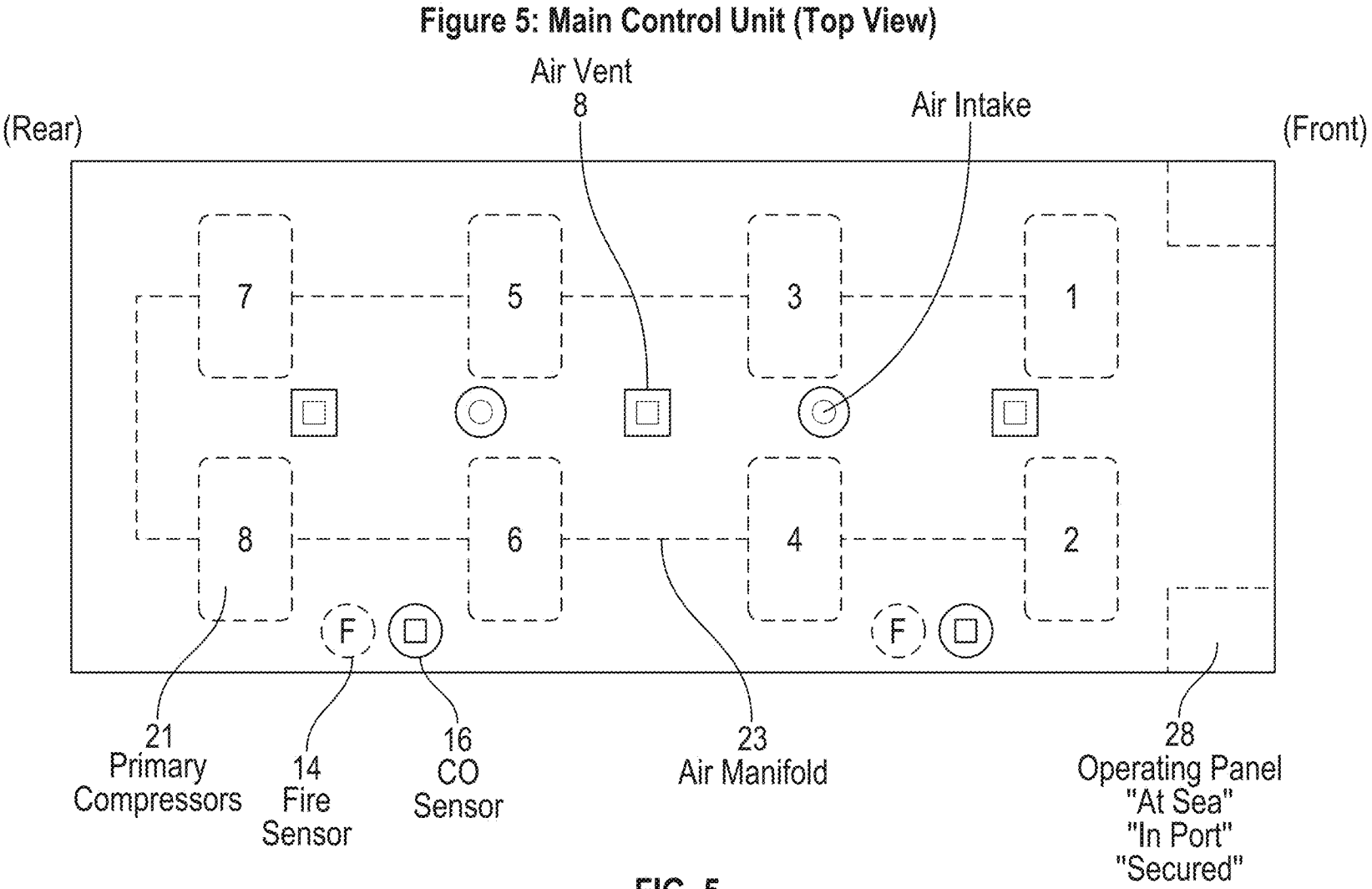
FIG. 5 is an exemplary representation of a top view of the main control unit, in accordance with some embodiments.

FIG. 5 is an exemplary representation of a top view of the main control unit to facilitate the providing and the sustaining of the laminar flow of the fluid across the vessel, in accordance with some embodiments.

Figure 6:
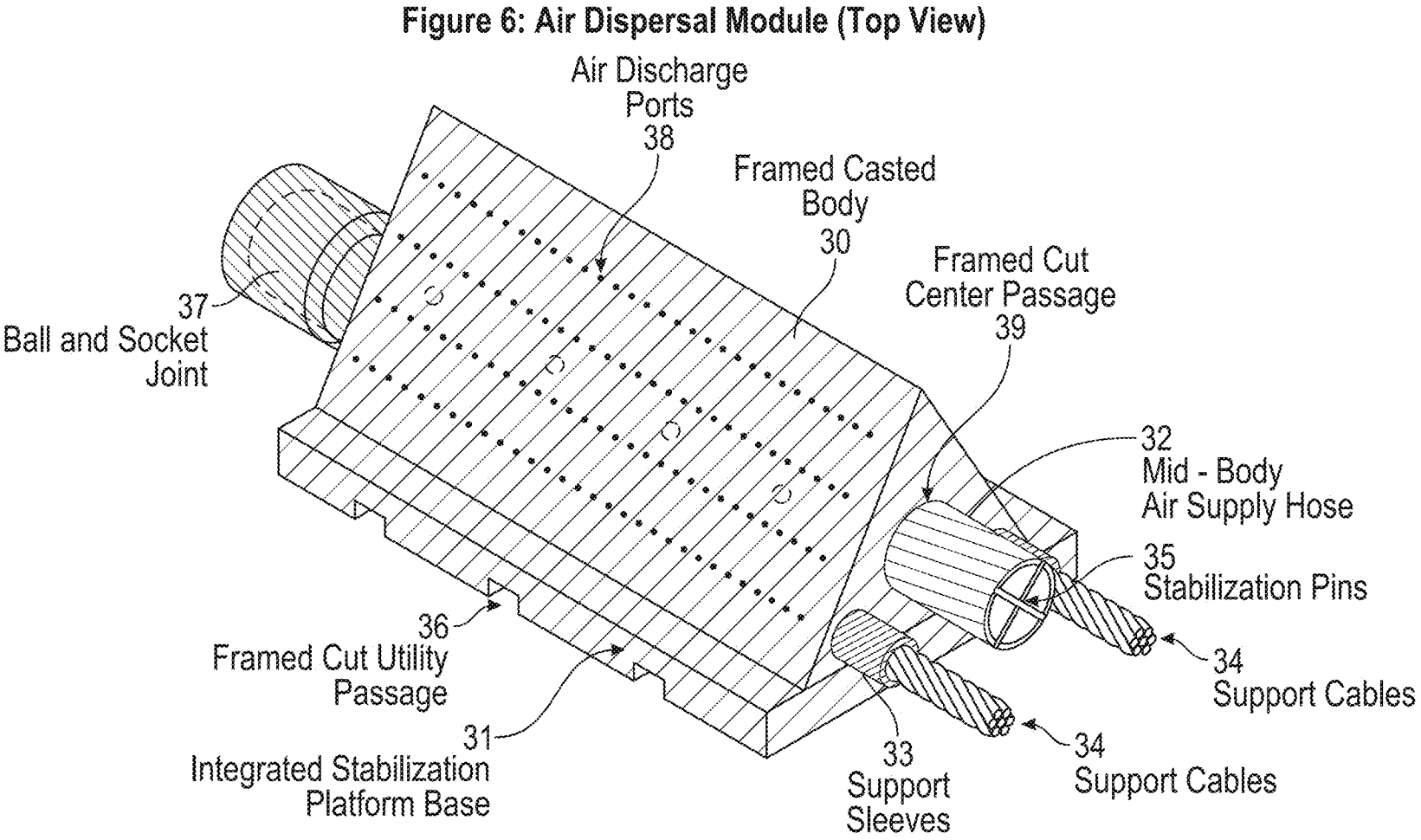
FIG. 6 is an exemplary representation of a top perspective view of an air dispersal module to facilitate providing and sustaining a laminar flow of the fluid across the vessel, in accordance with some embodiments.

FIG. 6 is an exemplary representation of a top perspective view of an air dispersal module to facilitate the providing and the sustaining of the laminar flow of the fluid across the vessel, in accordance with some embodiments. Further, the system may include a plurality of air dispersal modules. Further, the plurality of air dispersal modules, in an instance, may facilitate distributing and/or discharging of the air across the wetted hull that may be produced and/or regulated by the plurality of main control units. Further, in some embodiments, each air dispersal module of the plurality of air dispersal modules may include a polyethylene cast, an equilateral triangular-shaped device with side measurements, in an instance, ranging from 2-12 in (or, inches), and a total length, in an instance, ranging from 2-4 ft (or, feet). Further, the triangular-shape may be specifically shaped to produce bubbles when generating the at least one air layer and be hydrodynamical to maximize laminar flow efficiency. Further, casting of an assembly corresponding to the each air dispersal module may include a rectangular shaped integrated stabilization platform base with a length spanning the assembly entirety, width extending 1-3 in beyond the length of triangular structure of the corresponding each air dispersal module on both of sides, and a thickness, in an instance, ranging from 0.5-2 in. Further, the casting of the assembly may correspond to a framed casted body. Further, in some embodiments, the framed casted body may be configured to be sufficiently rigid to protect a mid-body air supply hose (32) that may traverse center of the framed casted body (30). Further, in some embodiments, the framed casted body, may be configured to be sufficiently malleable to support effective tailoring of the corresponding air dispersal module to the wetted hull. Further, in some embodiments, the each air dispersal module may include a circular framed cut center passage (39) that may include the mid-body air supply hose. Further, the mid-body air supply hose may facilitate flowing of the air to the waterborne components of the system and/or the wetted hull. Further, the mid-body air supply hose, in an instance, may include a cylindrical, braided, and/or reinforced shape. Further, in some embodiments, the each air dispersal module may include at least two equally-spaced stabilization pins (35) that may extend through a diameter of the framed cut center passage and the reinforced mid-body air supply hose. Further, in some embodiments, the at least two equally-spaced stabilization pins may not extend beyond internal dimensions of surrounding triangular casting. Further, the at least two equally-spaced stabilization pins may prevent internal shifting of the reinforced mid-body air supply hose within the surrounding framed cut center passage. Further, in some embodiments, the each air dispersal module may include at least three support sleeves of diameter, in an instance, ranging from 0.375-0.625 in that may be located above the integrated stabilization platform base (31) and below the framed cut center passage. Further, the at least three support sleeves (33) may facilitate encompassing support cables. Further, each support cable (34) may include a diameter, in an instance, ranging from 0.25-0.50 in. Further, in some embodiments, the each air dispersal module may include at least two equally spaced earth magnets (40) (e.g., samarium cobalt magnets) below the integrated stabilization platform base. Further, the at least two equally spaced earth magnets, in an instance, may be cast in a manner that may ensure a minimum 0.5 in thickness of the polyethylene material between the surface of the at least two equally spaced earth magnets and surface of the wetted hull. Further, the at least two equally spaced earth magnets, in an instance, may provide adherence to the wetted hull surface and stability corresponding to tensioning associated with the support cables. Further, in some embodiments, a framed cut utility passage (36) with width measurements and height measurements of 1 in and 0.5 in respectively, to facilitate addition of other components as required over time.

Figure 7:
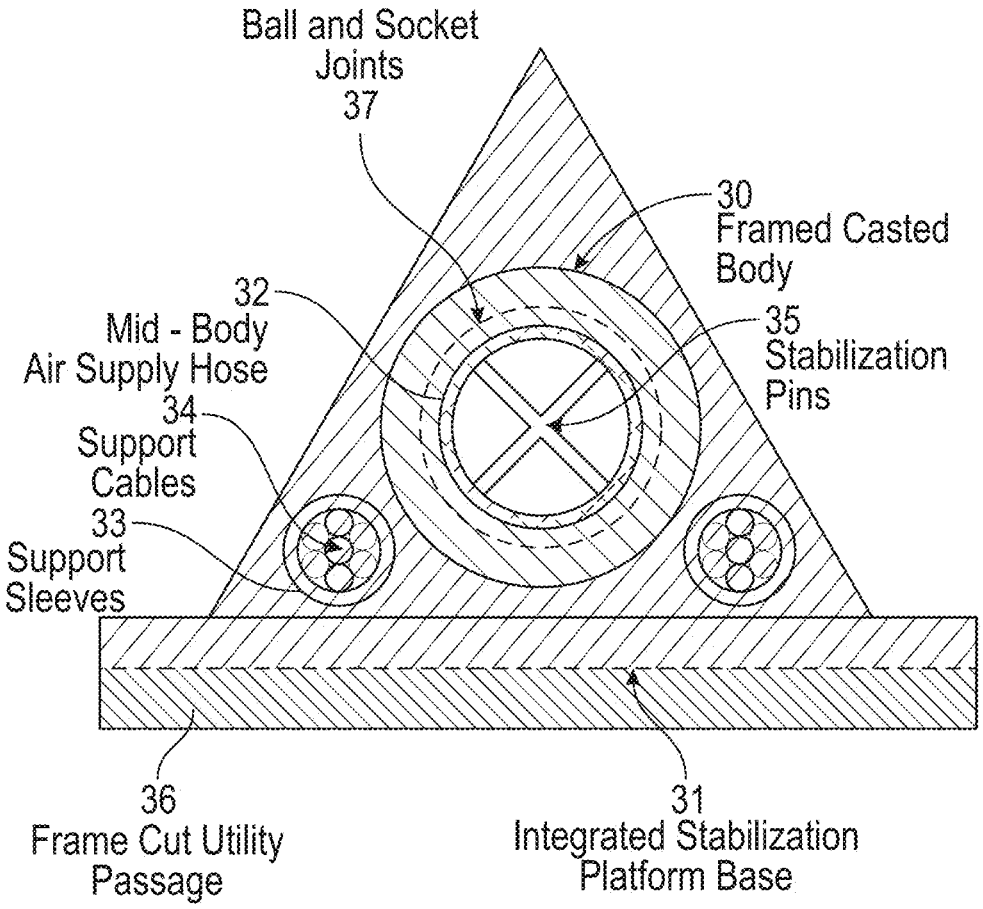
FIG. 7 is an exemplary representation of a front view of the air dispersal module, in accordance with some embodiments.

FIG. 7 is an exemplary representation of a front view of the air dispersal module to facilitate the providing and the sustaining of the laminar flow of the fluid across the vessel, in accordance with some embodiments.

Figure 8:
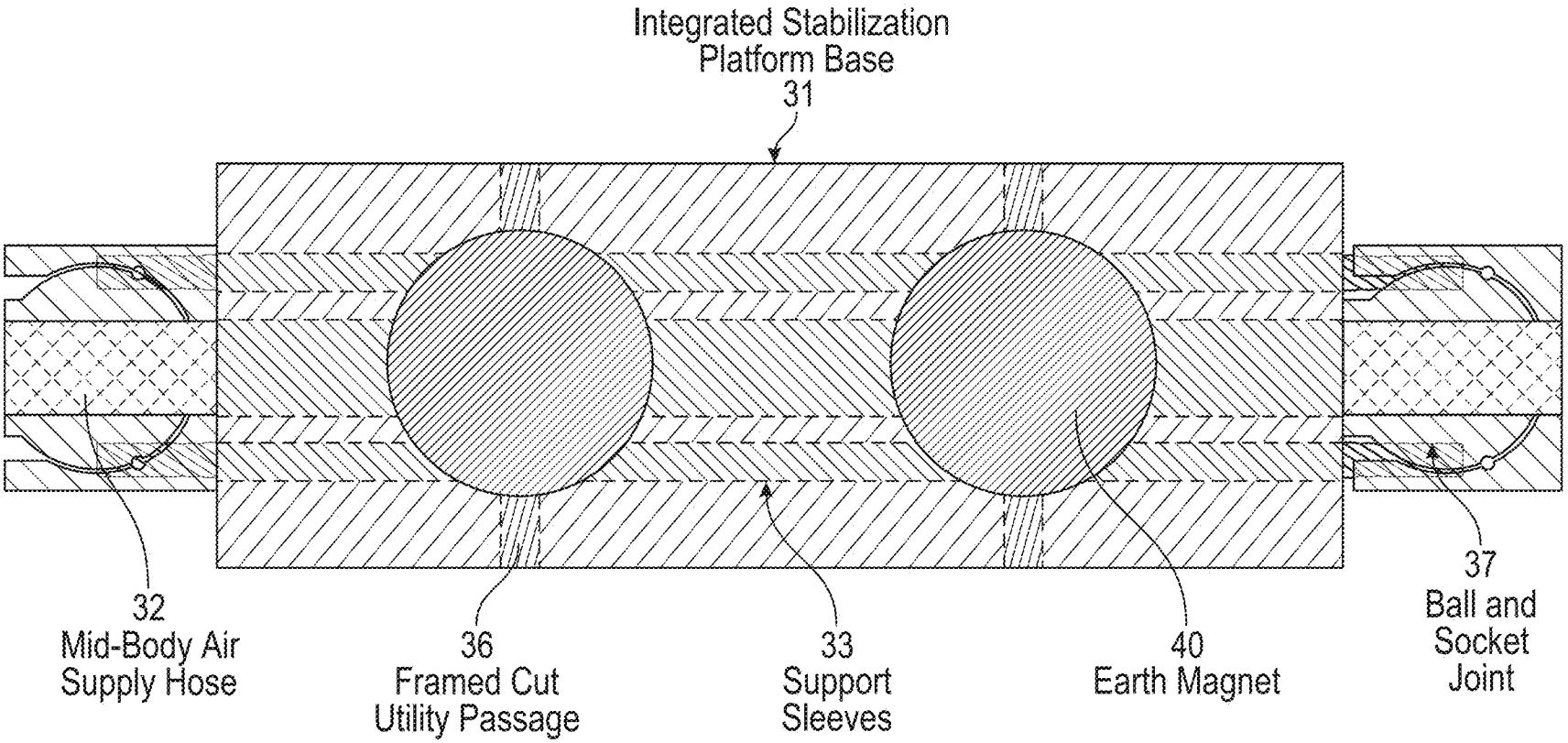
FIG. 8 is an exemplary representation of a bottom view of the air dispersal module, in accordance with some embodiments.

FIG. 8 is an exemplary representation of a bottom view of the air dispersal module to facilitate the providing and the sustaining of the laminar flow of the fluid across the vessel, in accordance with some embodiments.

Figure 9:
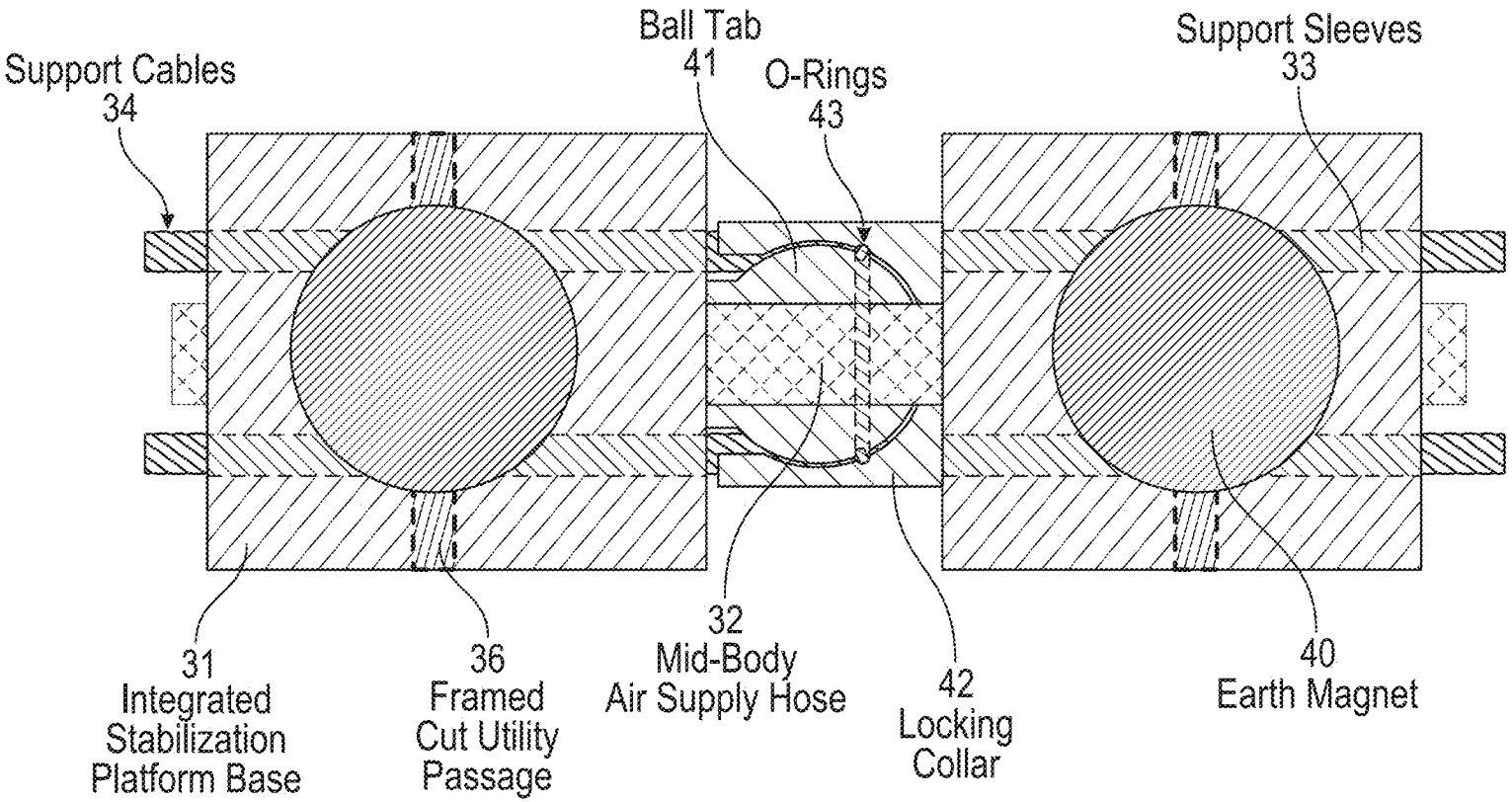
FIG. 9 is an exemplary representation of a bottom view of a ball and socket joint interconnecting a plurality of air dispersal modules, in accordance with some embodiments.

FIG. 9 is an exemplary representation of a bottom view of a ball and socket joint (37) interconnecting a plurality of air dispersal modules to facilitate the providing and the sustaining of the laminar flow of the fluid across the vessel, in accordance with some embodiments. Further, the each air dispersal module may be equipped with a ball and socket joint. A ball tab (41) is inserted into the locking collar (42) with O-Rings (43) maintaining a water-tight fit between the two parts. Further, the ball and socket joint may facilitate interconnection of individual air dispersal module that may result in a series of an interconnected plurality of air dispersal modules. Further, in some embodiments, the ball and socket joint may include polyethylene material. Further, in some embodiments, the series of an interconnected plurality of air dispersal modules may facilitate creating of one or more integrated longitudinal air distribution assemblies that, in an instance, may range from 10-60 ft. Further, in some embodiments, a first set of the plurality of the air dispersal modules may be outfitted with strategically oriented air discharge ports (38) that may facilitate directed air release towards the surface of the wetted hull. Further, in some embodiments, a second set of the plurality of air dispersal modules may be unperforated that may facilitate supporting unfettered air distribution to one or more locations of one or more integrated longitudinal air distribution assemblies associated with perforated air dispersal modules. Further, each ball and socket joint of the each air dispersal module may include at least one O-ring that may prevent air leakage between one or more interconnected air dispersal modules. Further, in some embodiments, earth magnets and support cables may facilitate securing of the individual and/or interconnected air dispersal modules to the wetted hull, thereby ensuring effective system operation and/or safety without operational limitation to the corresponding vessel.

Figure 10:
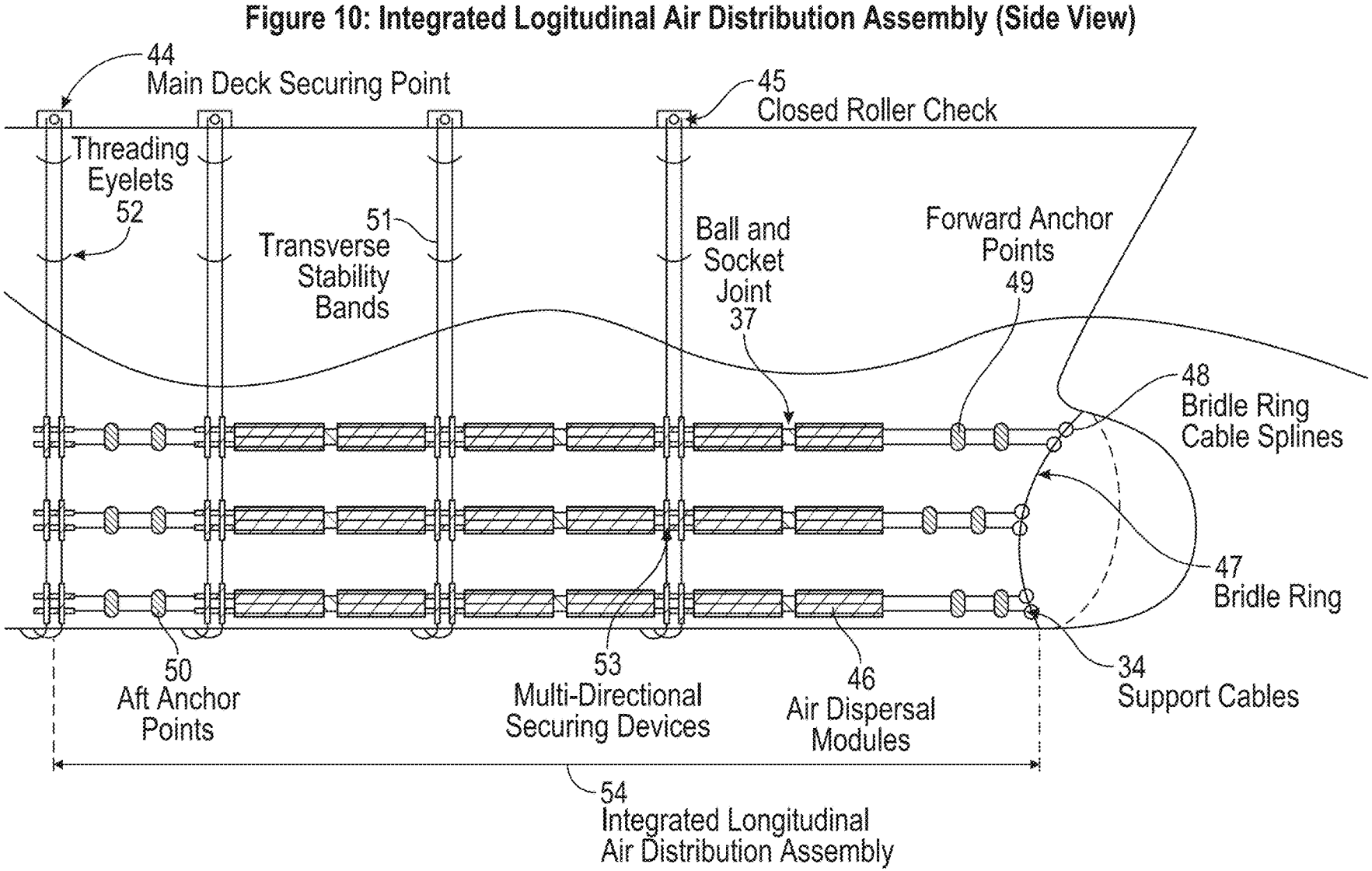
FIG. 10 is an exemplary representation of a side view of an integrated longitudinal air distribution assembly to facilitate providing and sustaining a laminar flow of the fluid across the vessel, in accordance with some embodiments.

FIG. 10 is an exemplary representation of a side view of an integrated longitudinal air distribution assembly to facilitate the providing and the sustaining of the laminar flow of the fluid across the vessel, in accordance with some embodiments. Further, one or more integrated longitudinal air distribution assemblies (54) may span across the wetted hull of the vessel. Further, the one or more longitudinal air distribution assemblies may facilitate discharging of the air continuously across the surface of the wetted hull of the vessel, thereby sustaining at least one air layer between the wetted hull and surrounding fluid (such as, water, etc.). Further, a series of an interconnected plurality of air dispersal modules (46) may facilitate creating of one or more integrated longitudinal air distribution assemblies that, in an instance, may range from 10-60 ft. Further, in some embodiments, structural integrity associated with the one or more integrated longitudinal air distribution assemblies may be achieved based on a combination of one or more of at least one forward securing bridle, one or more transverse stability bands (51), and one or more multi-directional securing devices (53) (explained in conjunction with FIG. 11, FIG. 12, FIG. 13, FIG. 14, FIG. 15, FIG. 16, and FIG. 17). The forward securing bridle may hold the system in place so it does not slip aft during system operations when the pressure against the entire system is most vulnerable to pressure from water pressure. Further, the forward securing bridle may be connected to the transverse stability bands by way of the multi-directional securing devices. The multi-directional securing devices may hold the transverse stability bands to the forward securing bridle. Further, the one or more integrated longitudinal air distribution assemblies may be strategically positioned across the wetted hull from a point of origin at and/or near bow associated with the vessel to points of termination near stern of the vessel and/or as far aft (i.e., towards the stern of the vessel) as necessary that may ensure maximum air layer effectiveness across the wetted hull. Further, the strategically positioning, in an instance, may be based on the dimensions and/or size of the corresponding vessel (such as, length, beam, draft, etc.), underwater hull configuration, and air production and/or distribution that may be required to sustain the air layer necessary for reduction of viscous resistance ($R_v$) and sound isolation. Further, in some embodiments, the one or more integrated longitudinal air distribution assemblies, in an instance, may range from 10-1200 ft as required. Further, in some embodiments, the one or more integrated longitudinal air distribution assemblies may include a section of perforated air dispersal modules. Further, the one or more integrated longitudinal air distribution assemblies may include a section of non-perforated air dispersal modules. Further, in some embodiments, the combination of the section of the perforated air dispersal modules and the section of the non-perforated air dispersal modules may facilitate supporting of delivering and/or sustaining airflow at one or more desired locations across the wetted hull. Further, a number of earth magnets (40) that may be evenly spaced throughout entirety of the one or more integrated longitudinal air distribution assemblies may provide sufficient adherence to support initial positioning of the one or more integrated longitudinal air distribution assemblies. Further, full securing of the one or more integrated longitudinal air distribution assemblies may be accomplished by forward and/or aft tensioning of support cables (34) traversing through support sleeves (33) that may be included in each air dispersal module of the one or more integrated longitudinal air distribution assemblies.

Figure 11:
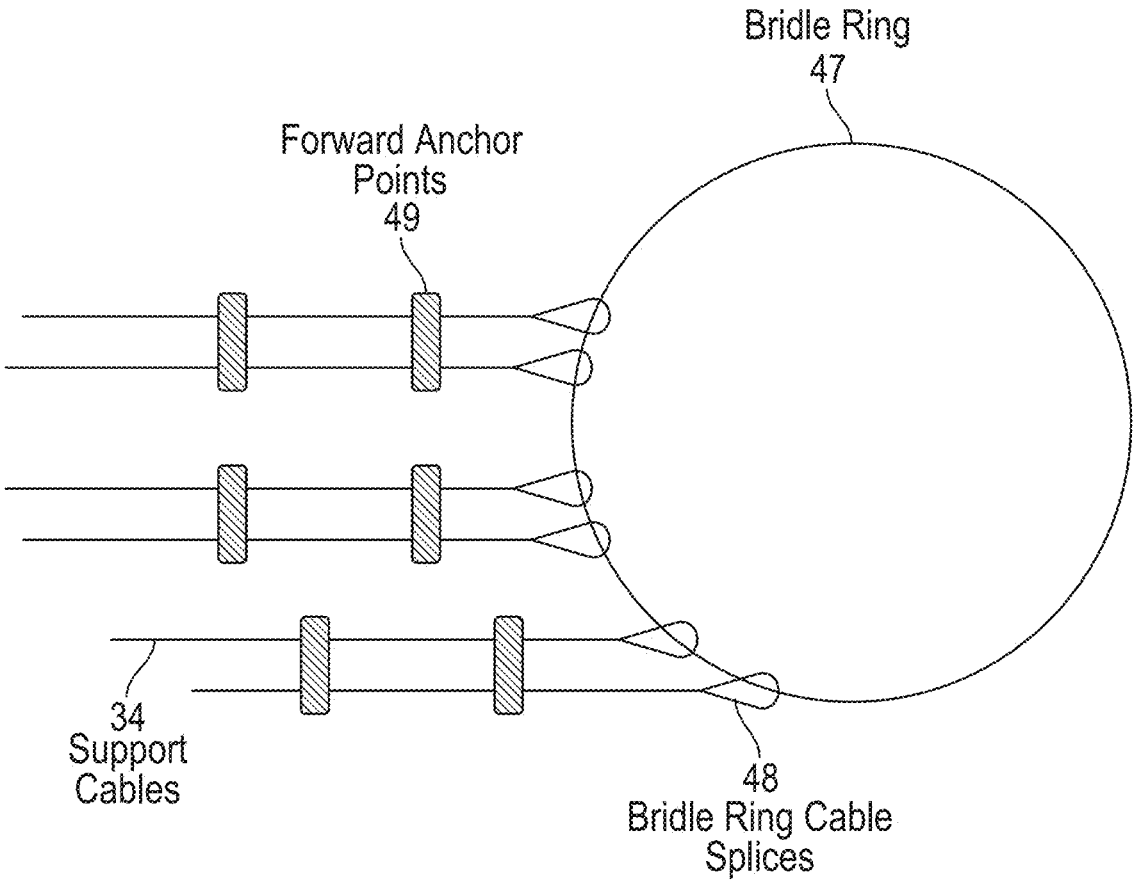
FIG. 11 is an exemplary representation of a front view of a forward securing bridle to facilitate providing and sustaining the laminar flow of the fluid across the vessel, in accordance with some embodiments.

FIG. 11 is an exemplary representation of a front view of a forward securing bridle to facilitate the providing and the sustaining of the laminar flow of the fluid across the vessel, in accordance with some embodiments. Further, the forward securing bridle may facilitate the distribution of the one or more integrated longitudinal air distribution assemblies across the surface of the wetted hull on either side of the vessel. Further, the system may include the forward securing bridle that may serve as the origination point for the one or more integrated longitudinal air distribution assemblies irrespective of the vessel including or not including a bulbous bow. Further, in some embodiments, the forward securing bridle may include an ovular-shaped diaphragm that originates at bow of the vessel. Further, in some embodiments, a bridle ring (47) associated with the forward securing bridle may include a steel cable that may, in an instance, range from 0.25-2 inches in diameter. Further, the bridle ring may be encased within a protective sleeve to prevent deterioration associated with friction between the bridle ring and the hull of the corresponding vessel. Further, in some embodiments, support cables may be physically spliced to the bridle ring. Further, the support cables may extend through a region corresponding to the laminar flow that may originate at the bow. Further, in some embodiments, at least two forward anchoring points may be independently welded to the hull to affix the support cables of each of the one or more integrated longitudinal air distribution assemblies to the hull. Further, a combination of the support cables physically spliced with the bridle ring and the at least two forward anchoring points at the cable splice (48), in an instance, may facilitate distributing of forward tension of the support cables, affords structural redundancy, and/or minimize stress on one or more welded areas that may be configured to secure the at least two forward anchoring points (49) to the hull. Further, the support cables may terminate at the aft of the vessel by being welded directly into the hull or, alternatively, may wrap around to the other side of the vessel, connecting air distribution assemblies from the two sides of the vessel. Further, an alternative to the bridle ring may be direct welds to the vessel itself connecting the support cable to the hull of the vessel only using welds.

Figure 12:
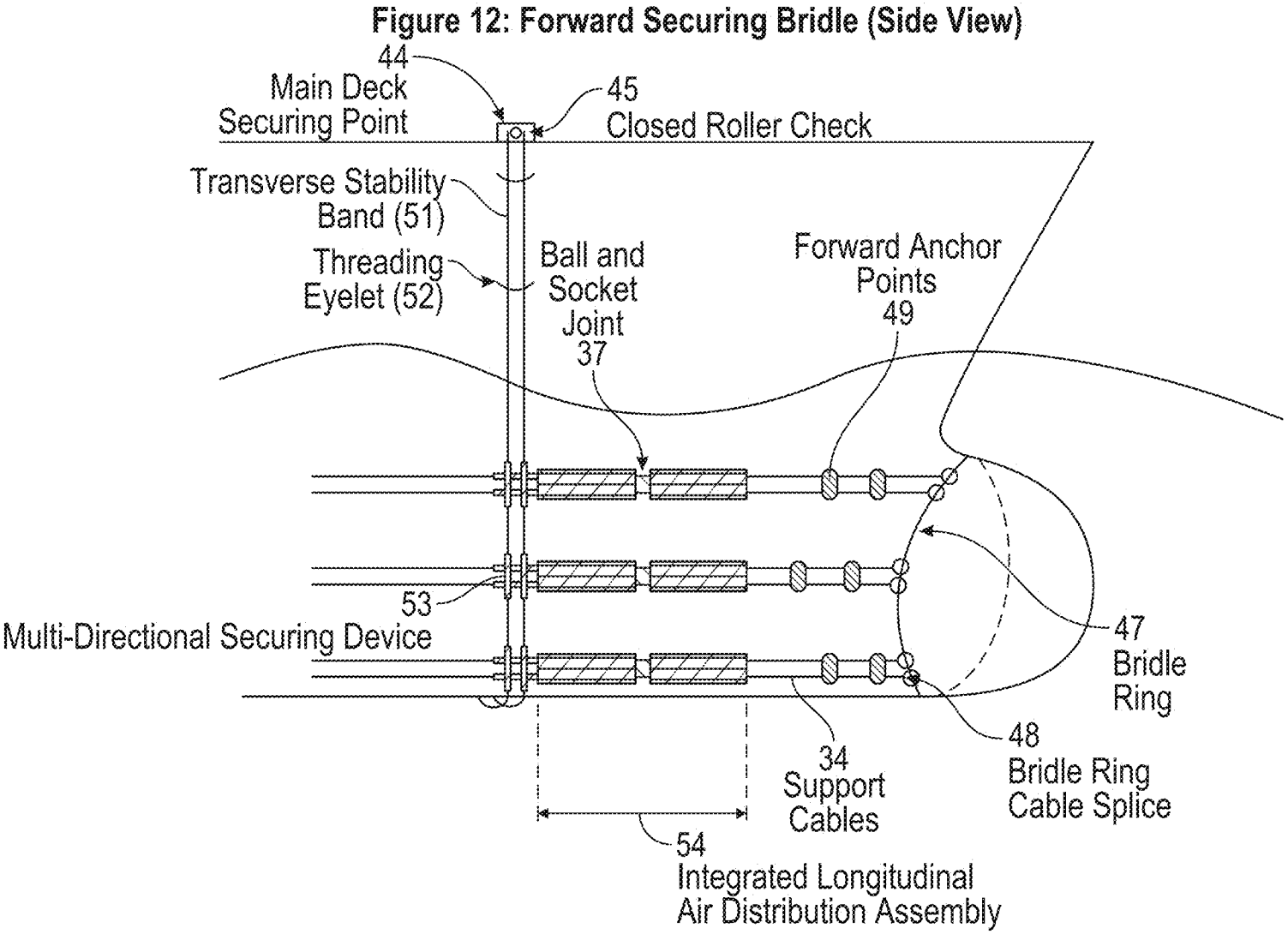
FIG. 12 is an exemplary representation of a side view of the forward securing bridle, in accordance with some embodiments.

FIG. 12 is an exemplary representation of a side view of the forward securing bridle to facilitate the providing and the sustaining of the laminar flow of the fluid across the vessel, in accordance with some embodiments.

Figure 13:
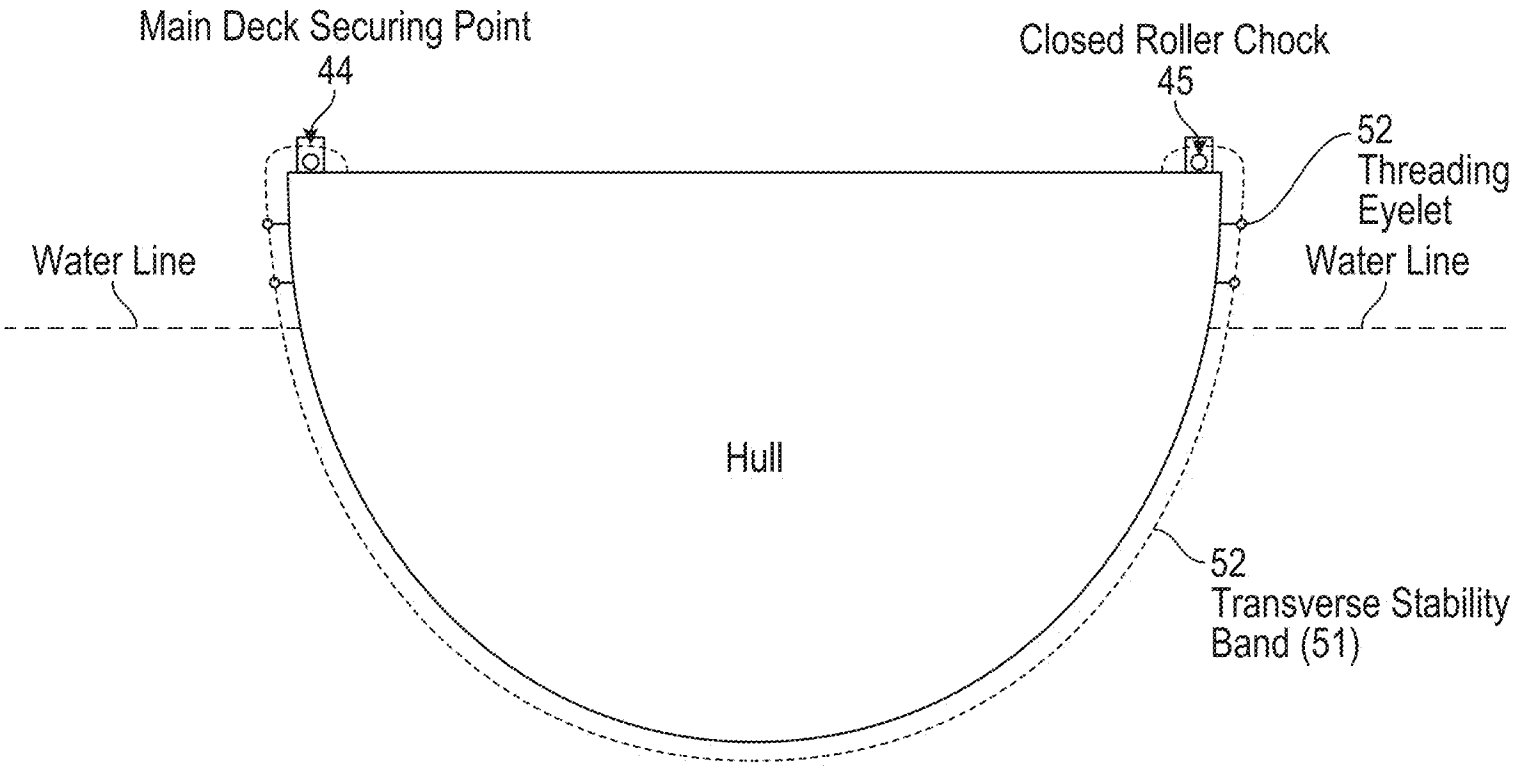
FIG. 13 is an exemplary representation of a front view of transverse stability bands to facilitate providing and sustaining the laminar flow of the fluid across the vessel, in accordance with some embodiments.

FIG. 13 is an exemplary representation of a front view of transverse stability bands to facilitate the providing and the sustaining of the laminar flow of the fluid across the vessel, in accordance with some embodiments. Further, incremental securing of the one or more integrated longitudinal air distribution assemblies may be achieved using the one or more transverse stability bands. Further, in some embodiments, the one or more transverse stability bands may be intermittently spaced (i.e., at a distance of 40-100 ft) along the vessel. Further, the one or more transverse stability bands may include one or more multi-directional securing devices that may provide stability and/or tension to support cables spanning entirety of the one or more integrated longitudinal air distribution assemblies. Further, in some embodiments, each of the one or more transverse stability bands may include a set of two independent stainless-steel cables that may include a diameter, in an instance, ranging from 0.5-2.5 in. Further, each of the two independent stainless-steel cables of the each of the one or more transverse stability bands may be independently encased within protective sleeves to prevent deterioration and/or reduce friction between a transverse stability band and the hull of the vessel. Further, the one or more transverse stability bands may be tensioned between one or more port and/or starboard main deck securing points (44) that may anchor the one or more transverse stability bands devices with the vessel and/or exterior hull that may be above waterline. Further, the each of the transverse stability bands may originate at the at least one of the at least two forward anchoring points on one side of the vessel, extend through a closed roller chock (45) that may provide tensioning of the each of the transverse stability bands, and traverses through one or more threading eyelets (52) along a freeboard associated with port/starboard of the vessel. Further, each of the transverse stability bands may include a two-cable tandem that may continue under the hull, reemerges on the opposing side of the vessel, extends through additional threading eyelets, and ultimately terminates on the deck after being secured by aft anchor points (50) and passing through a final closed roller chock. Further, the one or more transverse stability bands (51) may underlap the one or more integrated longitudinal air distribution assemblies at nearly perpendicular angles along the wetted hull of the vessel, including both bottom and sides of the vessel.

Figure 14:
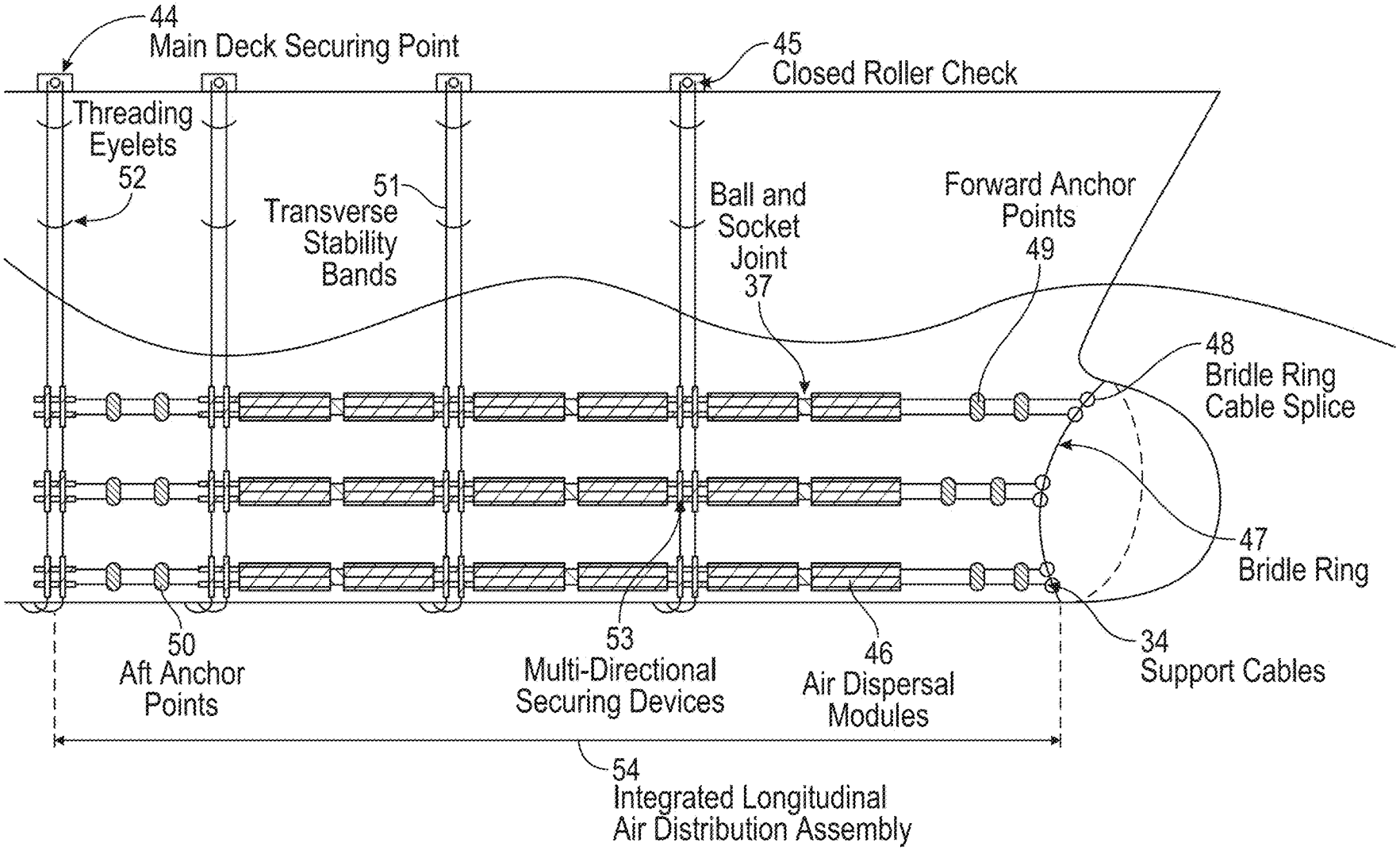
FIG. 14 is an exemplary representation of a side view of transverse stability bands to facilitate providing and sustaining the laminar flow of the fluid across the vessel, in accordance with some embodiments.

FIG. 14 is an exemplary representation of a side view of transverse stability bands to facilitate the providing and the sustaining of the laminar flow of the fluid across the vessel, in accordance with some embodiments.

Figure 15:
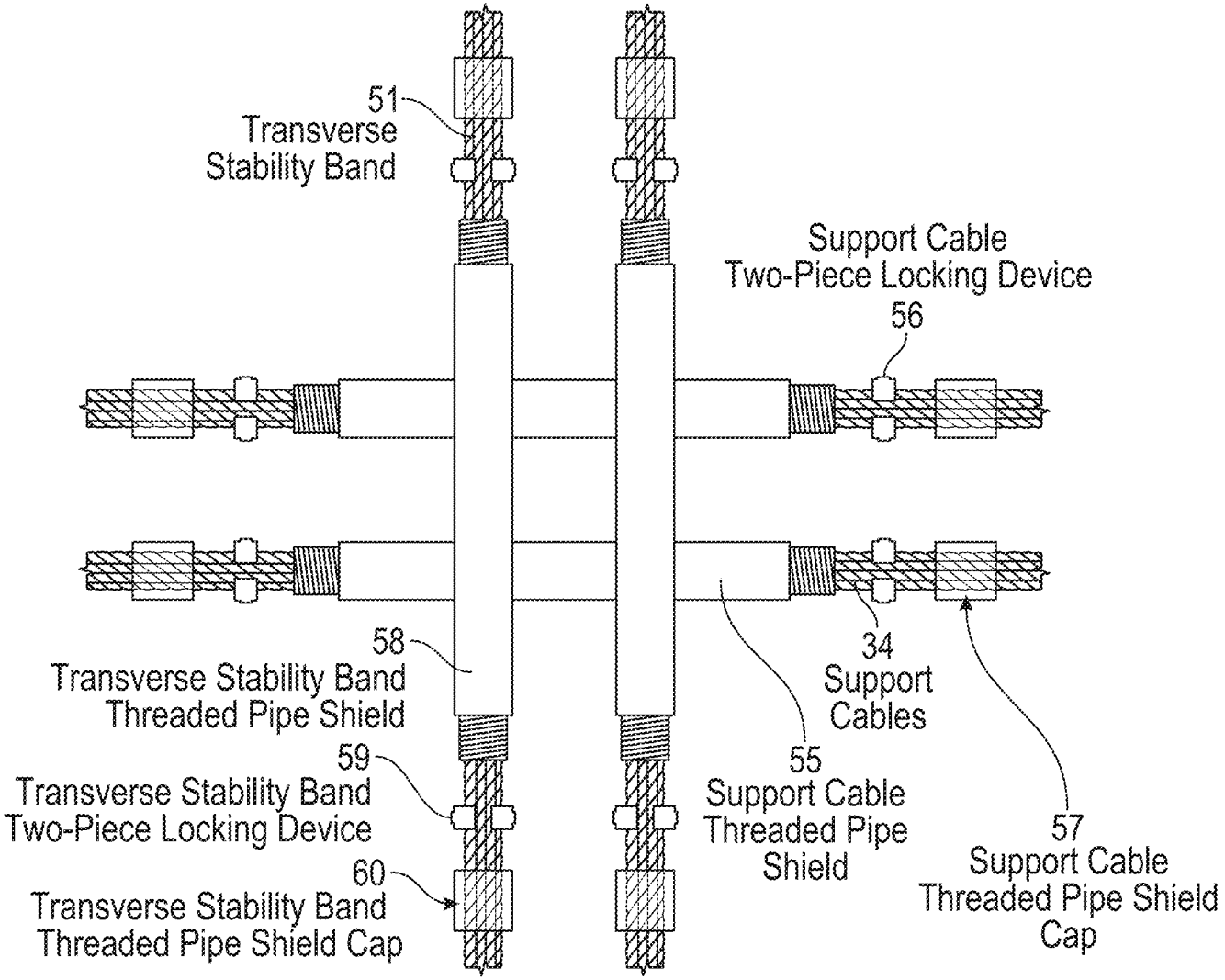
FIG. 15 is an exemplary representation of a bottom side of a multi-directional securing device to facilitate providing and sustaining the laminar flow of the fluid across the vessel, in accordance with some embodiments.

FIG. 15 is an exemplary representation of a bottom side of a multi-directional securing device to facilitate the providing and the sustaining of the laminar flow of the fluid across the vessel, in accordance with some embodiments. Further, the system may include the one or more multi-directional securing devices (53). Further, in some embodiments, each multi-directional securing device of the one or more multi-directional securing devices may include one or more primary components that may facilitate distributing of tension along the one or more integrated longitudinal air distribution assemblies (54) and/or providing of stability to a network of the one or more integrated longitudinal air distribution assemblies in one or more longitudinal and/or transverse directions. Further, the one or more transverse stability bands may utilize the one or more multi-directional securing devices. Further, the one or more primary components may include an integrated set of at least four stainless-steel threaded pipe shields that may be oriented in a perpendicular configuration. Further, two threaded pipe shields (58) of the at least four stainless-steel threaded pipe shields may be configured for use with the transverse stability band cables. Further, other two threaded pipe shields (55) of the at least four stainless-steel threaded pipe shields may be configured for using with the support cables associated with each of the one or more integrated longitudinal air distribution assembly. Further, in some embodiments, each of the at least four threaded pipe shields may include an inner diameter, in an instance, of 0.125 in such that the inner diameter may be sufficient to surround each of the transverse stability band cables (51) and the support cables (34) to provide protection against external damage. Further, in some embodiments, each of the at least four threaded pipe shields may be threaded to ensure smaller pipe shield pieces may be interlocked by being screwed together. Further, alternatives to pipe shields may be to not have anything installed, which may provide less protection to the cables, or to use a metal shroud around the cables, which may dramatically increase drag and weight. Further, the one or more primary components may include at least one two-piece locking device and at least one threaded pipe shield cap that may be employed at ends of the each of the at least four threaded pipe shields. Further, a first two-piece locking device (56) of the at least one two-piece locking device and a first threaded pipe shield cap (57) of the at least one threaded pipe shield cap may be first secured upon the support cables, followed by securing of a second two-piece locking device (59) of the at least one two-piece locking device and a second threaded pipe shield cap (60) of the at least one threaded pipe shield cap along with the transverse stability band cables. Further, the securing, in an instance, may complete installation process of the one or more integrated longitudinal air distribution assemblies and may afford the stability and distribution of the tension desired in both the longitudinal and the transverse directions. Further, each of the threaded pipe shield caps may be configured to protect the wires from becoming damaged, and each of the two-piece locking devices may be configured to lock one threaded pipe shield to another threaded pipe shield after the pipe shields are screwed together.

Figure 16:
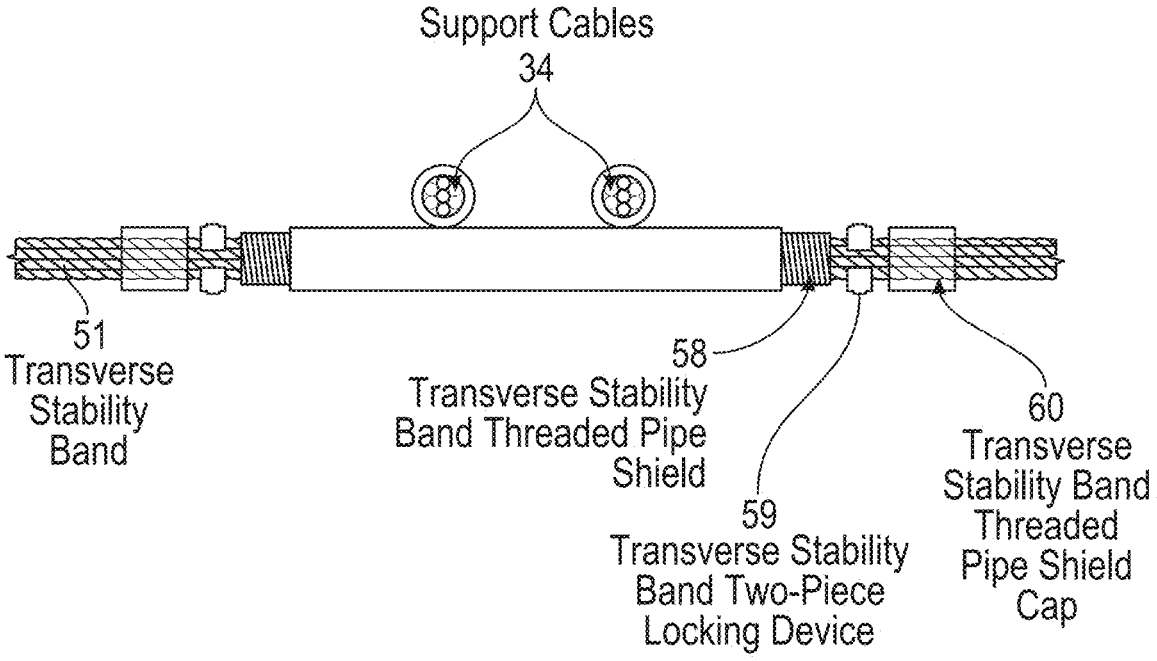
FIG. 16 is an exemplary representation of a side view of the multi-directional securing device, in accordance with some embodiments.

FIG. 16 is an exemplary representation of a side view of the multi-directional securing device to facilitate the providing and the sustaining of the laminar flow of the fluid across the vessel, in accordance with some embodiments.

Figure 17:
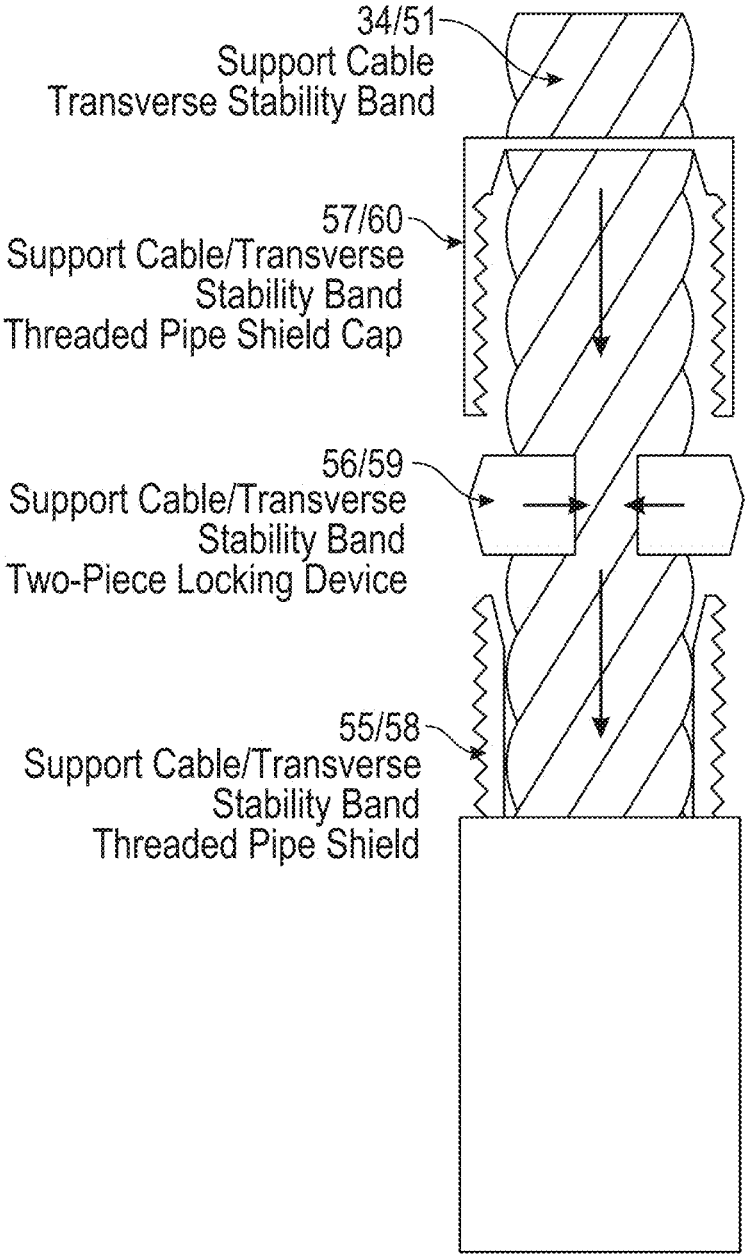
FIG. 17 is an exemplary representation of a component view of the multi-directional securing device, in accordance with some embodiments.

FIG. 17 is an exemplary representation of a component view of the multi-directional securing device to facilitate the providing and the sustaining of the laminar flow of the fluid across the vessel, in accordance with some embodiments.

Figure 18:
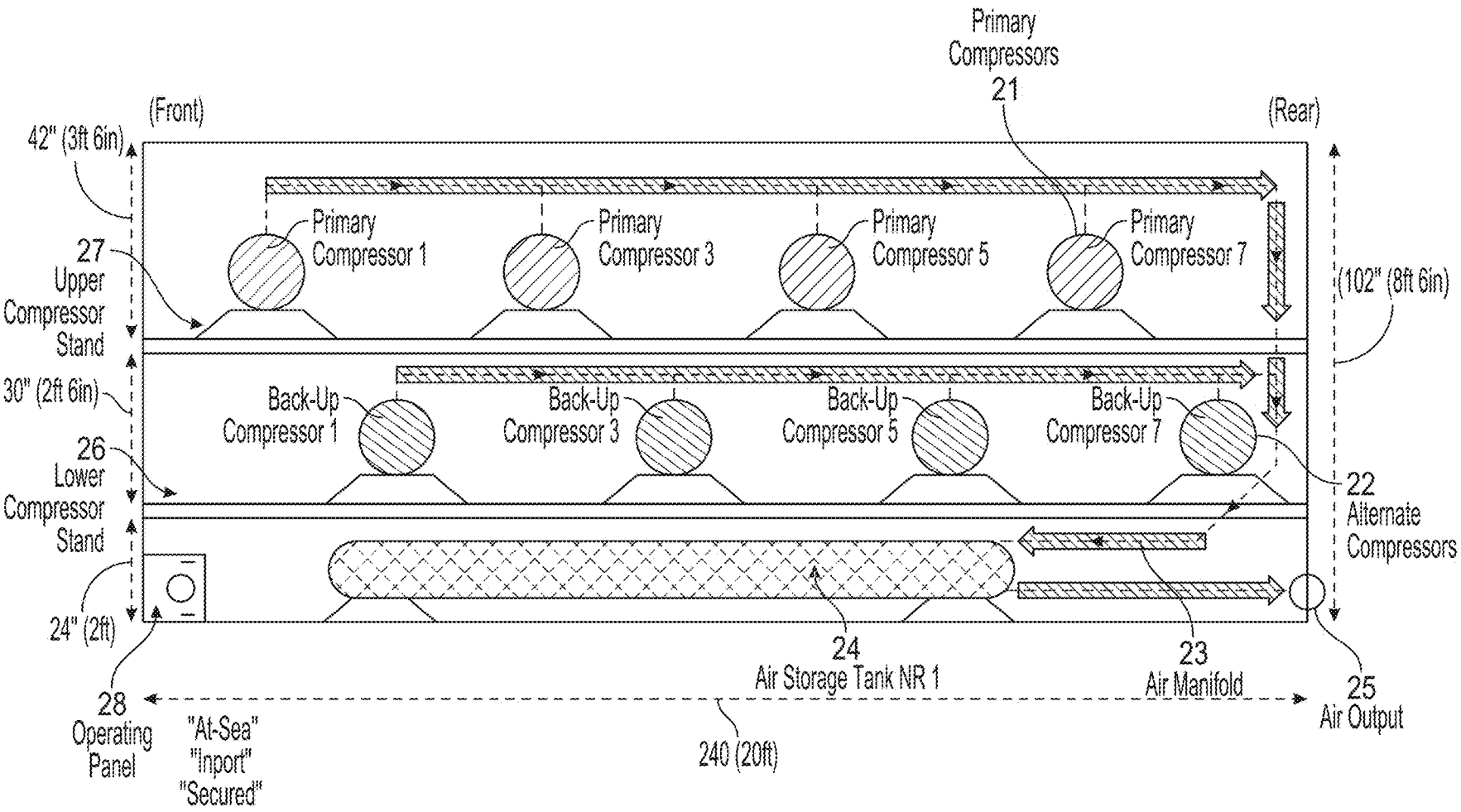
FIG. 18 is an exemplary representation of the air flow in the main control unit.

FIG. 18 is an exemplary representation of the air flow in the main control unit. The amount of air to be used by the air dispersal modules (46) may originate from the main control unit's primary and secondary air compressors (21, 22), and flow from the compressors through the air manifold (23). The air volume which is not needed at any given time may be saved in the air storage tank (24) for later use.

Figure 19:
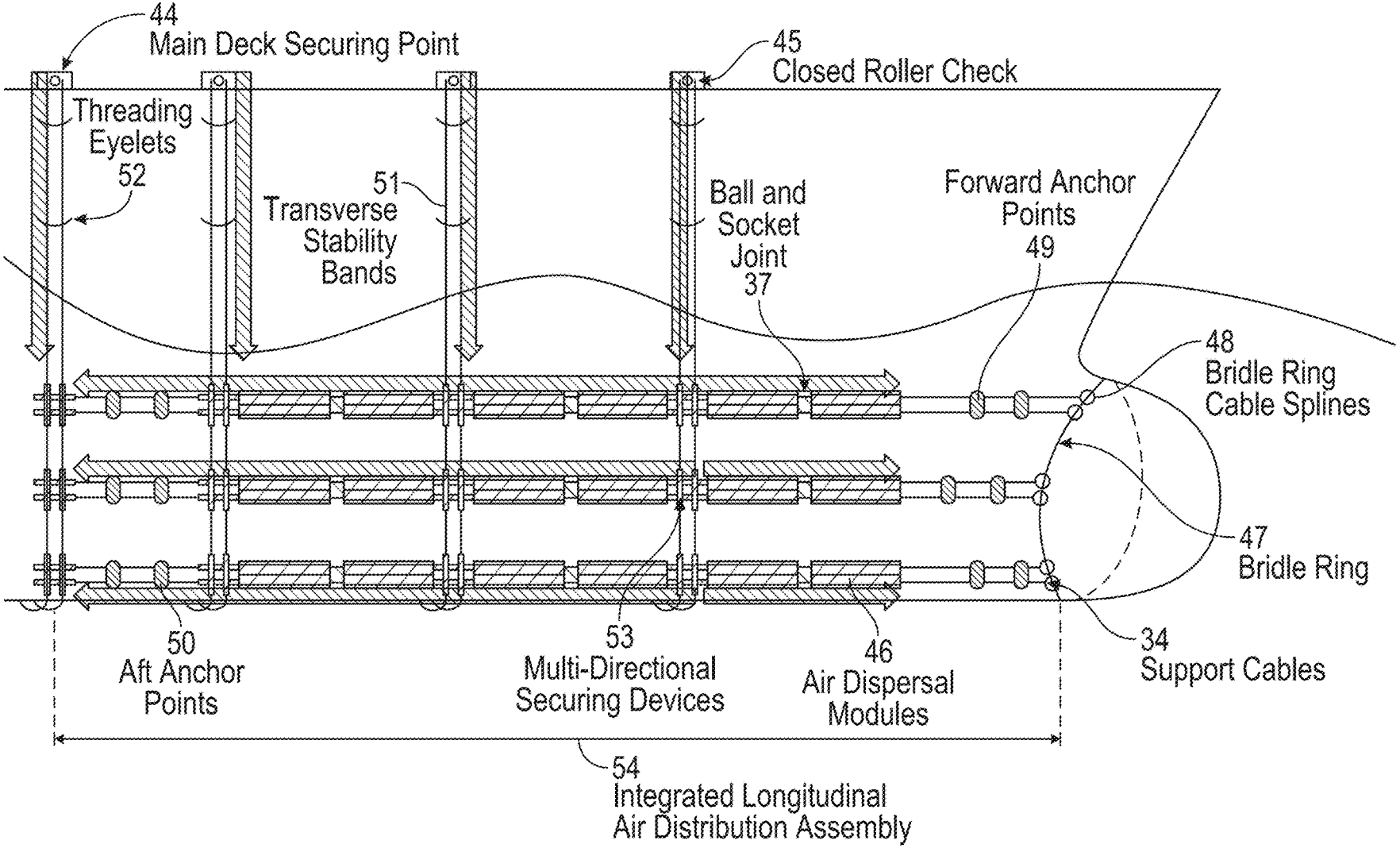
FIG. 19 is an exemplary representation of the air flow from the main control unit to the air dispersal modules.

FIG. 19 is an exemplary representation of the air flow from the main control unit to the air dispersal modules. The air required by the air dispersal modules (46) may flow from the main control unit via air hoses connected directly to the main control unit. The hoses from the main control unit may be connected to hoses found inside the transverse stability bands (51), allowing the air to flow directly overboard, directly to the air dispersal modules and, when necessary, through ball and socket joints (37).

Although the present disclosure has been explained in relation to its preferred embodiment, it is to be understood that many other possible modifications and variations can be made without departing from the spirit and scope of the disclosure.

What is claimed is:

1. A system for sustaining laminar flow of a fluid across a vessel, comprising:

a main control unit comprising one or more air compressor units, the one or more air compressor units configured to generate air; and an integrated longitudinal air distribution assembly secured to a wetted hull of the vessel, the integrated longitudinal air distribution assembly comprising:

a series of air dispersal modules configured to distribute the generated air across the wetted hull of the vessel to create at least one air layer between the wetted hull of the vessel and the fluid to sustain the laminar flow of the fluid across the vessel, and one or more support cables extending longitudinally along the wetted hull, wherein a proximal end of the one or more support cables is positioned at a bow of the vessel, and wherein a plurality of the air dispersal modules are attached to the one or more support cables.

2. The system of claim 1, wherein the main control unit further comprises an air manifold configured to discharge the air out of the main control unit.

3. The system of claim 1, further comprising one or more air hoses configured to transfer the air from the main control unit to the series of air dispersal modules.

4. The system of claim 1, further comprising one or more anchoring points on the wetted hull, wherein the one or more anchoring points are configured to secure the one or more support cables to the wetted hull.

5. The system of claim 1, further comprising a bridle positioned at a bow of the vessel.

6. The system of claim 5, wherein the bridle comprises a bridle ring affixed to the bow of the vessel.

7. The system of claim 1, further comprising a transverse stability band, wherein the transverse stability band is configured to traverse from one side of the vessel to a bottom of the wetted hull to an opposite side of the vessel.

8. The system of claim 1, further comprising a multi-directional securing device, the multi-directional securing device comprising one or more longitudinal pipe shields configured to surround the one or more support cables and one or more transverse pipe shields configured to surround one or more transverse stability bands, wherein the one or more longitudinal pipe shields and the one more or transverse pipe shields are oriented in a perpendicular configuration.

9. The system of claim 1, wherein the system is further configured to be installed while the vessel remains in the fluid.

10. The system of claim 1, wherein the at least one air dispersal module is further configured to generate the at least one air layer by producing a plurality of bubbles.

11. The system of claim 1, wherein the system is further configured to be installed by connecting the main control unit to the series of air dispersal modules along an exterior of the vessel.

12. The system of claim 1, wherein the at least one main control unit further comprises sound-dampening material.

13. The system of claim 1, wherein the system further comprises an operating panel for controlling the one or more air compressor units, the operating panel configured to support a first mode for operating at sea, a second mode for operating in port, a third mode for ceasing operation, or any combination thereof.

14. The system of claim 13, wherein the one or more air compressor units in the first mode is configured to provide low-pressure air ranging from 30-120 pound-force per square inch.

15. The system of claim 13, wherein the one or more air compressor units in the second mode is configured to provide a minimal air supply pressure ranging from 5-55 pound-force per square inch.

16. The system of claim 13, wherein the one or more air compressor units in the third mode is configured to eliminate all air supply.

17. The system of claim 1, wherein the at least one air compressor unit is further configured to be operable with water.

18. The system of claim 1, wherein each of the series of air dispersal modules is further configured to have a trident-shaped body.

19. The system of claim 1, wherein each of the series of air dispersal modules comprises a magnet configured to secure the air dispersal module to the wetted hull.

20. The system of claim 1, wherein each of the series of air dispersal modules further comprises a plurality of air discharge ports configured to discharge at least a portion of the air out of the air dispersal module.

21. The system of claim 1, wherein each of the series of air dispersal modules further comprises an air supply hose configured to transfer at least a portion of the air through the air dispersal module.

* * * * *